US010946606B2

(12) United States Patent
Lepine et al.

(10) Patent No.: US 10,946,606 B2
(45) Date of Patent: Mar. 16, 2021

(54) MACHINE FOR MANUFACTURING INFLATED CUSHIONING PRODUCTS

(71) Applicant: Sealed Air Corporation (US), Charlotte, NC (US)

(72) Inventors: Jay D. Lepine, Dedham, MA (US); Brian A. Murch, Needham, MA (US); Laurence B. Sperry, Newton, MA (US)

(73) Assignee: Sealed Air Corporation (US), Charlotte, NC (US)

( * ) Notice: Subject to any disclaimer, the term of this patent is extended or adjusted under 35 U.S.C. 154(b) by 216 days.

(21) Appl. No.: 15/767,445

(22) PCT Filed: Oct. 19, 2016

(86) PCT No.: PCT/US2016/057707
§ 371 (c)(1),
(2) Date: Apr. 11, 2018

(87) PCT Pub. No.: WO2017/070212
PCT Pub. Date: Apr. 27, 2017

(65) Prior Publication Data

US 2018/0297317 A1 Oct. 18, 2018

Related U.S. Application Data

(60) Provisional application No. 62/243,985, filed on Oct. 20, 2015.

(51) Int. Cl.
*B31D 5/00* (2017.01)
*B31B 70/10* (2017.01)
(Continued)

(52) U.S. Cl.
CPC ..... *B31D 5/0073* (2013.01); *B31B 70/006* (2017.08); *B31B 70/10* (2017.08);
(Continued)

(58) Field of Classification Search
CPC ..... B31B 70/14; B31B 70/16; B31B 70/20; B31B 70/262; B31B 70/645;
(Continued)

(56) References Cited

U.S. PATENT DOCUMENTS 8,708,882 B2 * 4/2014 Chan ..... B31D 5/0047 493/464
2004/0022457 A1 * 2/2004 Brown ..... B29C 66/81433 383/37

(Continued)

OTHER PUBLICATIONS

Written Opinion of the International Searching Authority, issued in PCT/US2016/057707 dated Apr. 27, 2017.

*Primary Examiner* — Anna K Kinsaul
*Assistant Examiner* — Veronica Martin
(74) *Attorney, Agent, or Firm* — Jon M. Isaacson

(57) ABSTRACT

A machine for providing cushioning products of varying lengths from a supply of a web material having sequential transverse rows of inflated protrusions. A pair of opposing feed members form a feed nip for moving the web along a path of travel. At least one sensor detects location information for the sequential rows of inflated protrusions as the web travels along the path of travel. A severing device is moveable between (i) an engaged position to separate the web transversely or perforate the web transversely and (ii) a disengaged position. A controller is programmed (i) to receive the location information and (ii) to operatively control the severing device to move it to the engaged position when a selected row is in a determined position relative the severing device.

19 Claims, 21 Drawing Sheets

(51) Int. Cl.

| | |
|---|---|
| ***B31B 70/16*** | (2017.01) |
| ***B31B 70/36*** | (2017.01) |
| ***B31B 70/26*** | (2017.01) |
| ***B31B 70/64*** | (2017.01) |
| ***B31B 70/94*** | (2017.01) |
| ***B31B 70/00*** | (2017.01) |
| *B31B 160/10* | (2017.01) |
| *B31B 170/20* | (2017.01) |
| *B31B 155/00* | (2017.01) |
| *B31B 170/10* | (2017.01) |

(52) U.S. Cl.
CPC ..... *B31B 70/16* (2017.08); *B31B 70/262* (2017.08); *B31B 70/36* (2017.08); *B31B 70/642* (2017.08); *B31B 70/645* (2017.08); *B31B 70/946* (2017.08); *B31B 2155/0014* (2017.08); *B31B 2160/10* (2017.08); *B31B 2170/10* (2017.08); *B31B 2170/20* (2017.08); *B31D 2205/007* (2013.01); *B31D 2205/0023* (2013.01); *B31D 2205/0047* (2013.01); *B31D 2205/0052* (2013.01); *B31D 2205/0058* (2013.01); *B31D 2205/0064* (2013.01); *B31D 2205/0082* (2013.01); *B31D 2205/0088* (2013.01)

(58) Field of Classification Search
CPC ..... B31B 70/642; B31B 70/36; B31B 70/006; B31B 70/10; B31B 70/946; B31B 2170/20; B31B 2170/10; B31B 2155/0014; B31B 2160/10; B31D 5/0073; B31D 2205/0023; B31D 2205/0047; B31D 2205/0052; B31D 2205/0058; B31D 2205/0064; B31D 2205/007; B31D 2205/0082; B31D 2205/0088; B31D 5/0039–0078; B65B 63/04
USPC ..... 493/22, 350, 967, 186, 189, 192, 199, 493/203
See application file for complete search history.

(56) References Cited

U.S. PATENT DOCUMENTS

| | | | | |
|---|---|---|---|---|
| 2004/0045261 | A1* | 3/2004 | Sperry | B65B 49/06 53/436 |
| 2004/0192531 | A1* | 9/2004 | Meessen | B65H 19/1852 493/350 |
| 2004/0265523 | A1 | 12/2004 | Koyanagi | |
| 2007/0172326 | A1* | 7/2007 | Sperry | B65D 81/052 410/119 |
| 2008/0193263 | A1* | 8/2008 | Wetsch | B65H 20/00 414/222.04 |
| 2009/0293427 | A1 | 12/2009 | Lerner | |
| 2010/0251668 | A1* | 10/2010 | Sperry | B65B 31/06 53/403 |
| 2011/0072765 | A1 | 3/2011 | Salerno | |
| 2015/0075114 | A1* | 3/2015 | Murch | B29D 22/02 53/52 |
| 2019/0255798 | A1* | 8/2019 | Sperry | B65D 81/03 |

* cited by examiner

MACHINE FOR MANUFACTURING INFLATED CUSHIONING PRODUCTS

This application claims the benefit of U.S. Provisional Application No. 62/243,985 filed Oct. 20, 2015, which is incorporated herein in its entirety by reference.

The presently disclosed subject matter relates to a machine for providing cushioning products such as pouches, corner protectors, and sheets of desired lengths utilizing a feedstock of a web of inflated material.

SUMMARY

An embodiments of the presently disclosed subject matter includes a machine for providing cushioning products of varying lengths from a supply of a web material having sequential transverse rows of inflated protrusions. The machine includes a pair of opposing counter-rotating feed members forming a feed nip therebetween for moving the web through the feed nip from the supply and along a path of travel. At least one sensor is adapted to detect location information for the sequential rows of inflated protrusions as the web travels along the path of travel. A severing device is moveable between (i) an engaged position to contact the web to perform one or more of separating the web transversely across the web or perforating the web transversely across the web and (ii) a disengaged position not engaging the web to separate or perforate the web. A controller is programmed (i) to receive the location information from the at least one sensor and (ii) to operatively control the severing device to move it to the engaged position when a selected row is in a determined position relative the severing device.

These and other objects, advantages, and features of the presently disclosed subject matter will be more readily understood and appreciated by reference to the detailed description and the drawings.

Figure 1:
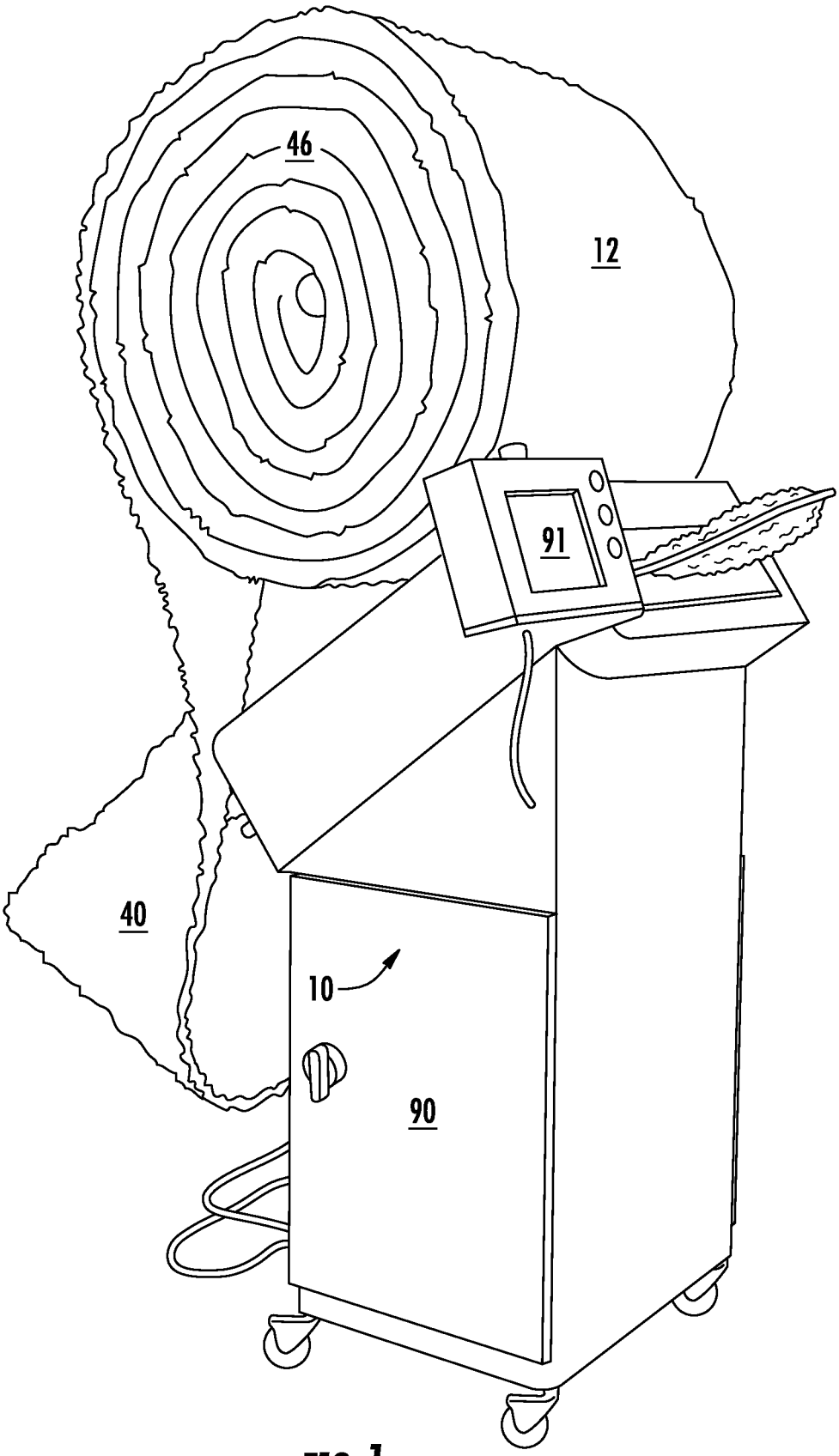
FIG. 1 is perspective view of a machine of the presently disclosed subject matter with a supply of web material.
Figure 2:
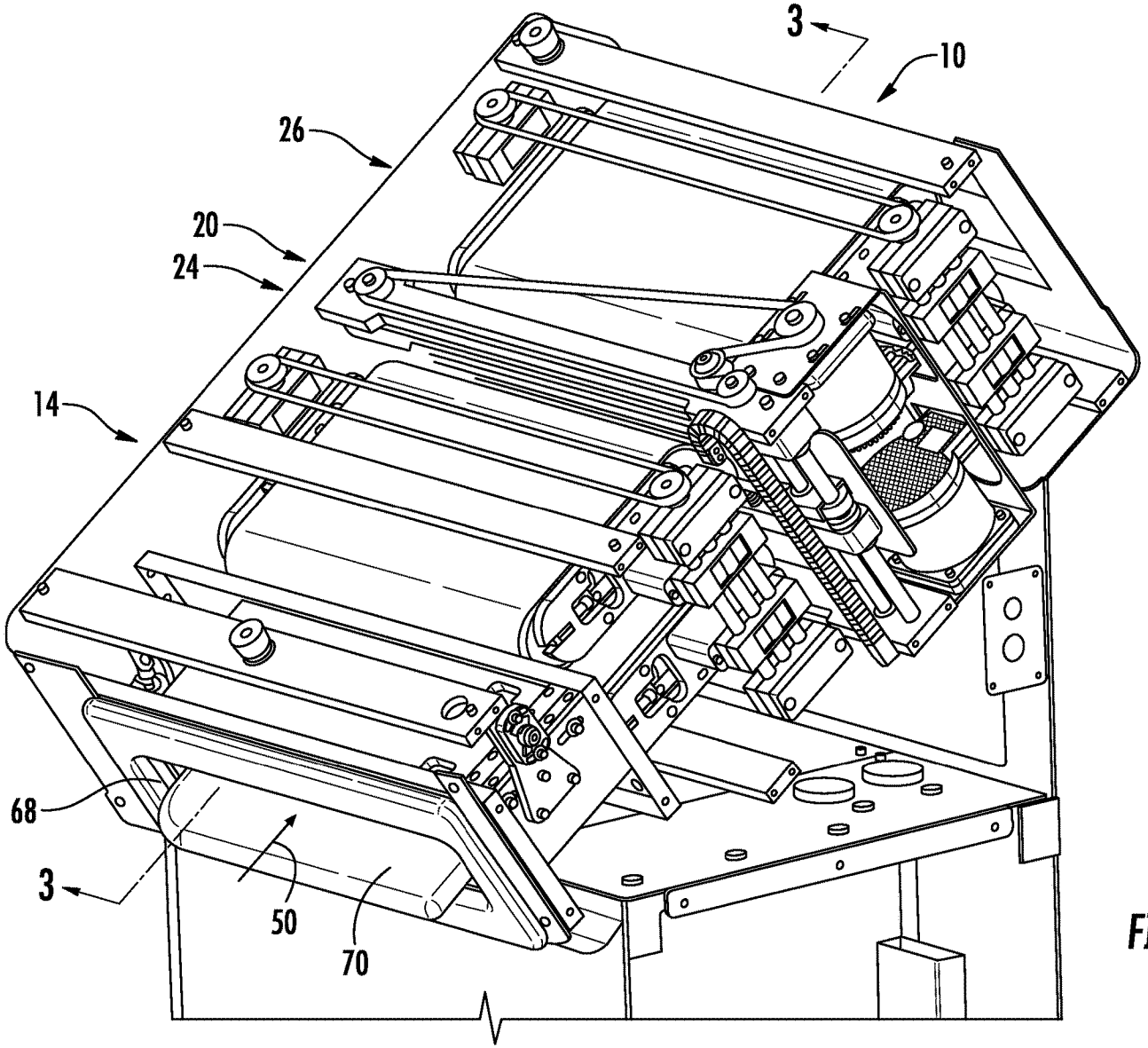
FIG. 2 is a representative perspective view of a portion of the machine of FIG. 1 having the top covering removed.

Various aspects of the subject matter disclosed herein are described with reference to the drawings. For purposes of simplicity, like numerals may be used to refer to like, similar, or corresponding elements of the various drawings. The drawings and detailed description are not intended to limit the claimed subject matter to the particular form disclosed. Rather, the intention is to cover all modifications, equivalents, and alternatives falling within the spirit and scope of the claimed subject matter.

DETAILED DESCRIPTION

One or more embodiments of the various machines (e.g., machine 10) of the presently disclosed subject matter for providing cushioning products of varying lengths from a supply 12 include one or more of a pair of opposing counter-rotating feed members 14, a forming plow 70, at least one sensor 94, a severing device 20, a piercing element 22, a sealing device 24, a pair of opposing counter-rotating outfeed members 26, and a controller 90, as will be discussed in more detail herein. (FIGS. 1 to 12.)

Figure 13:
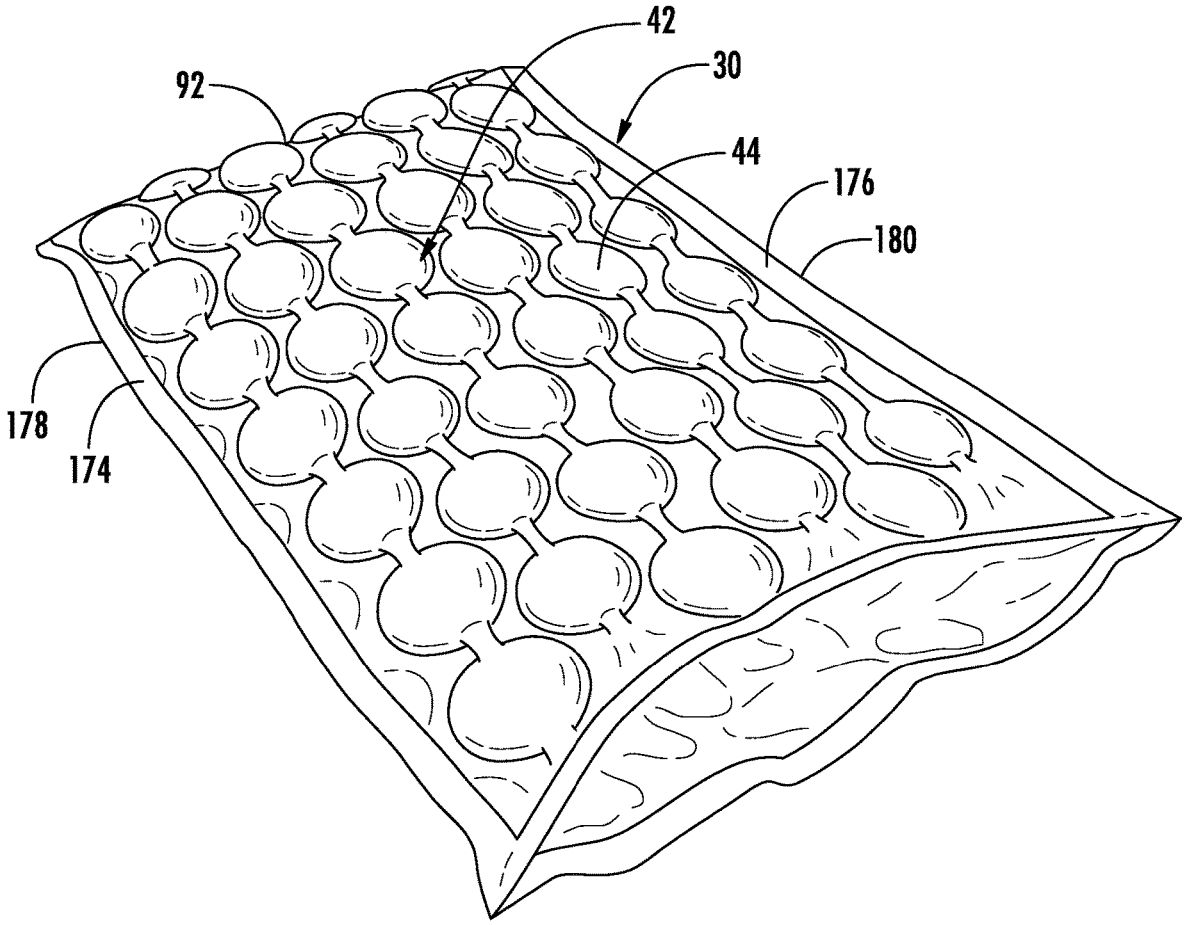
FIG. 13 is a perspective view of a pouch 30 cushioning product made by the machine of FIG. 1.
Figure 14:
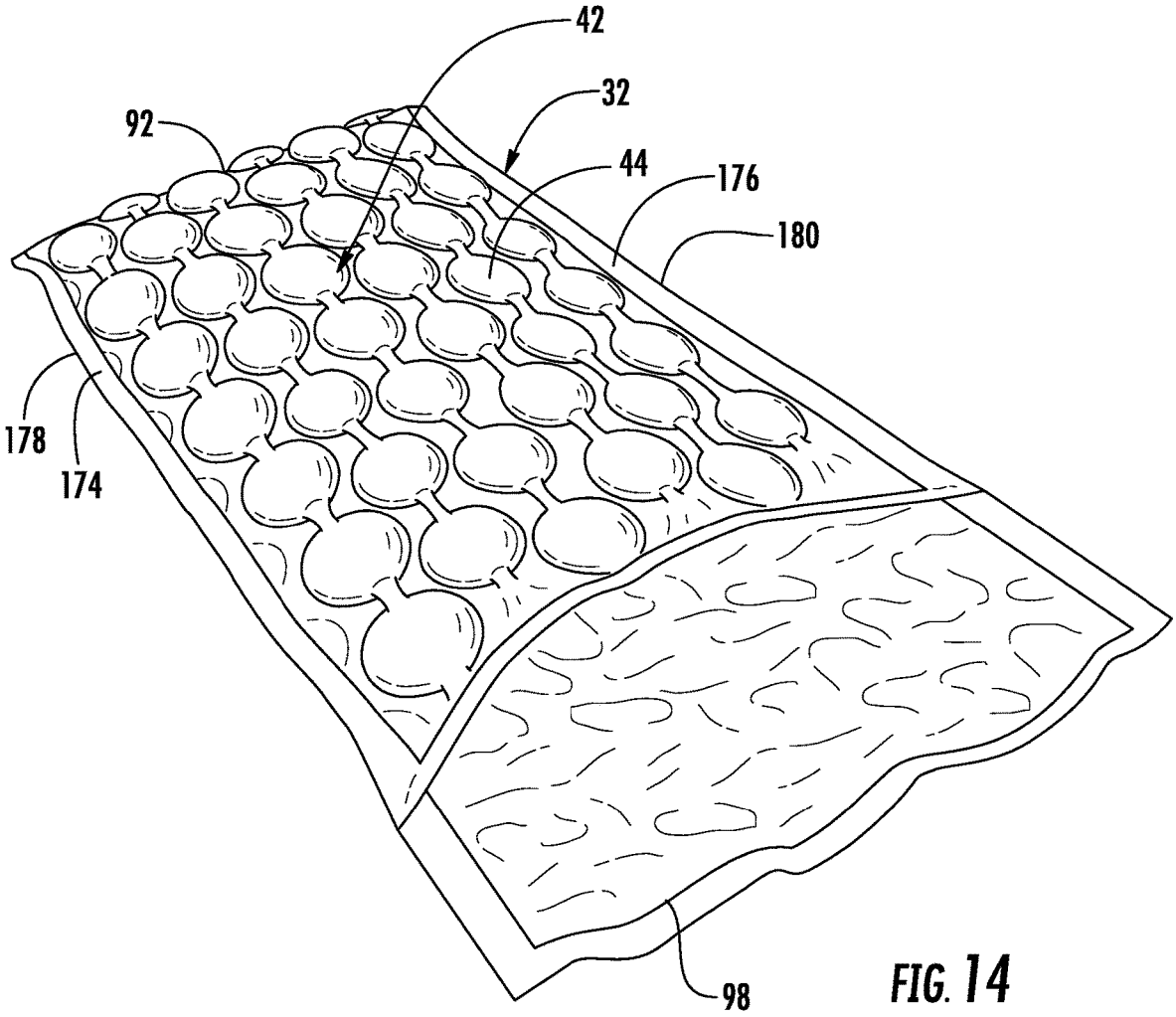
FIG. 14 is a perspective view of a pouch 32 (with a closure flap 94) cushioning product made by the machine of FIG. 1.
Figure 15:
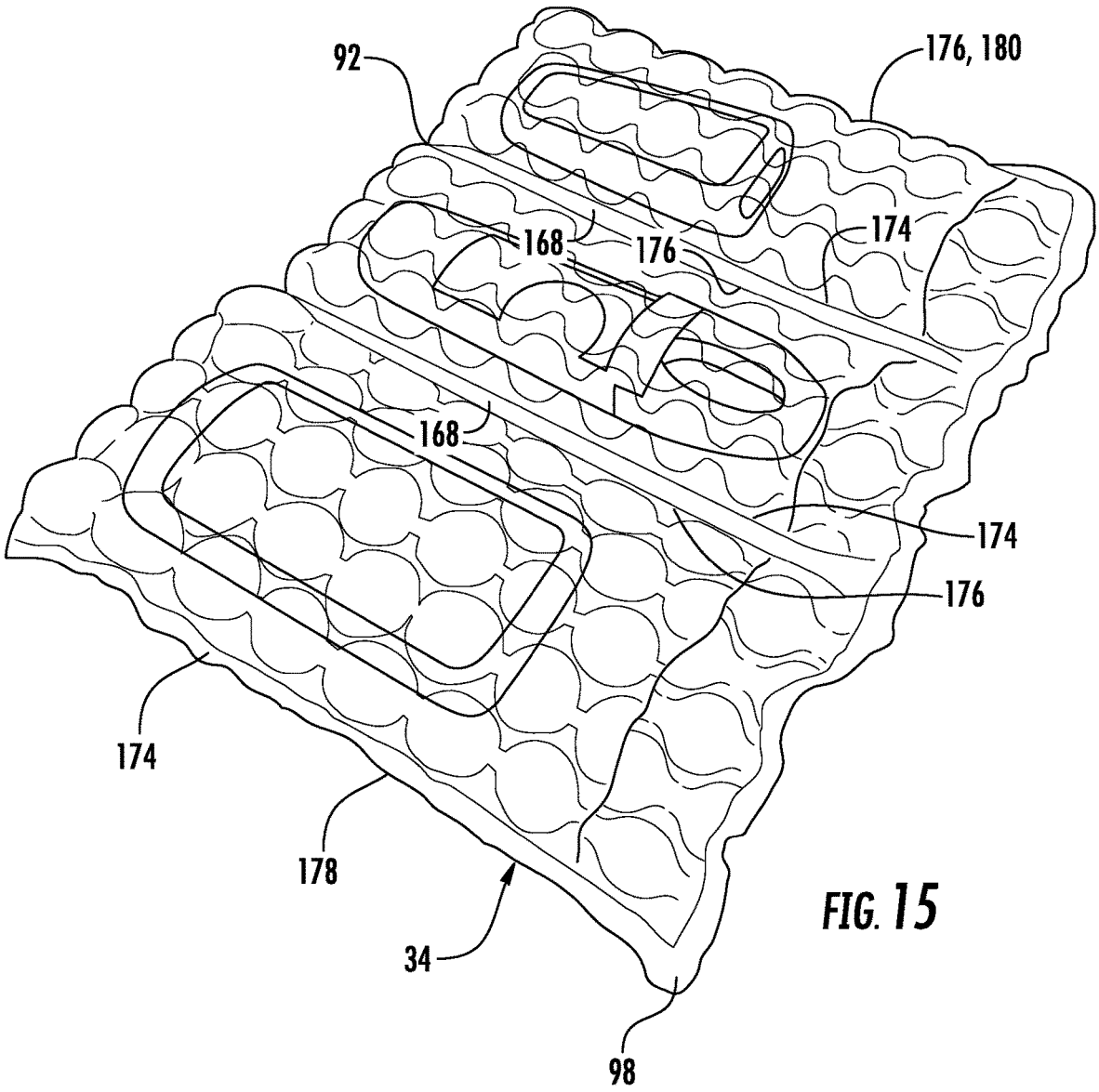
FIG. 15 is a perspective view of a string of pouches 34 cushioning product made by the machine of FIG. 1.
Figure 16:
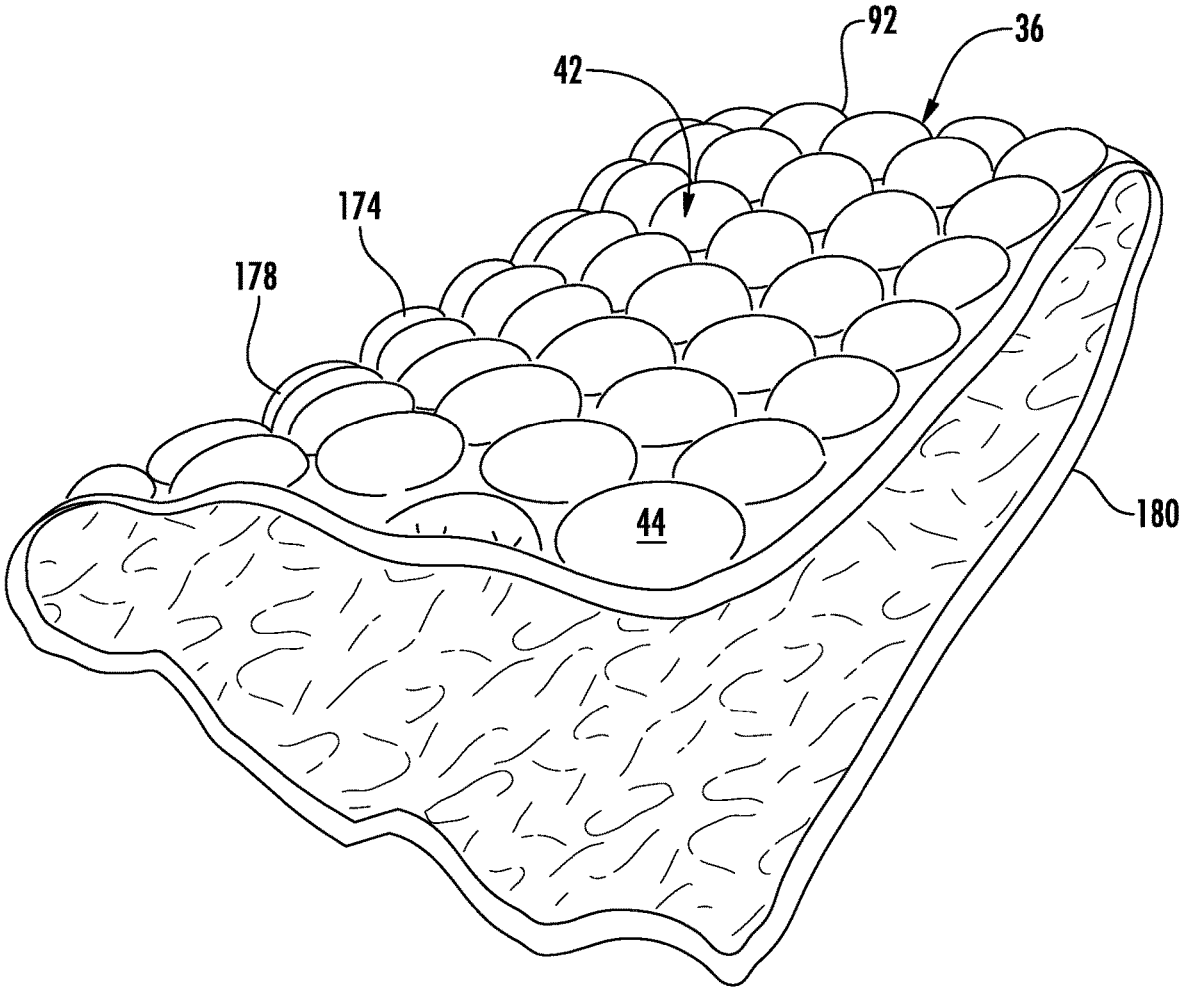
FIG. 16 is a perspective view of a corner protector 36 cushioning product made by the machine of FIG. 1.
Figure 17:
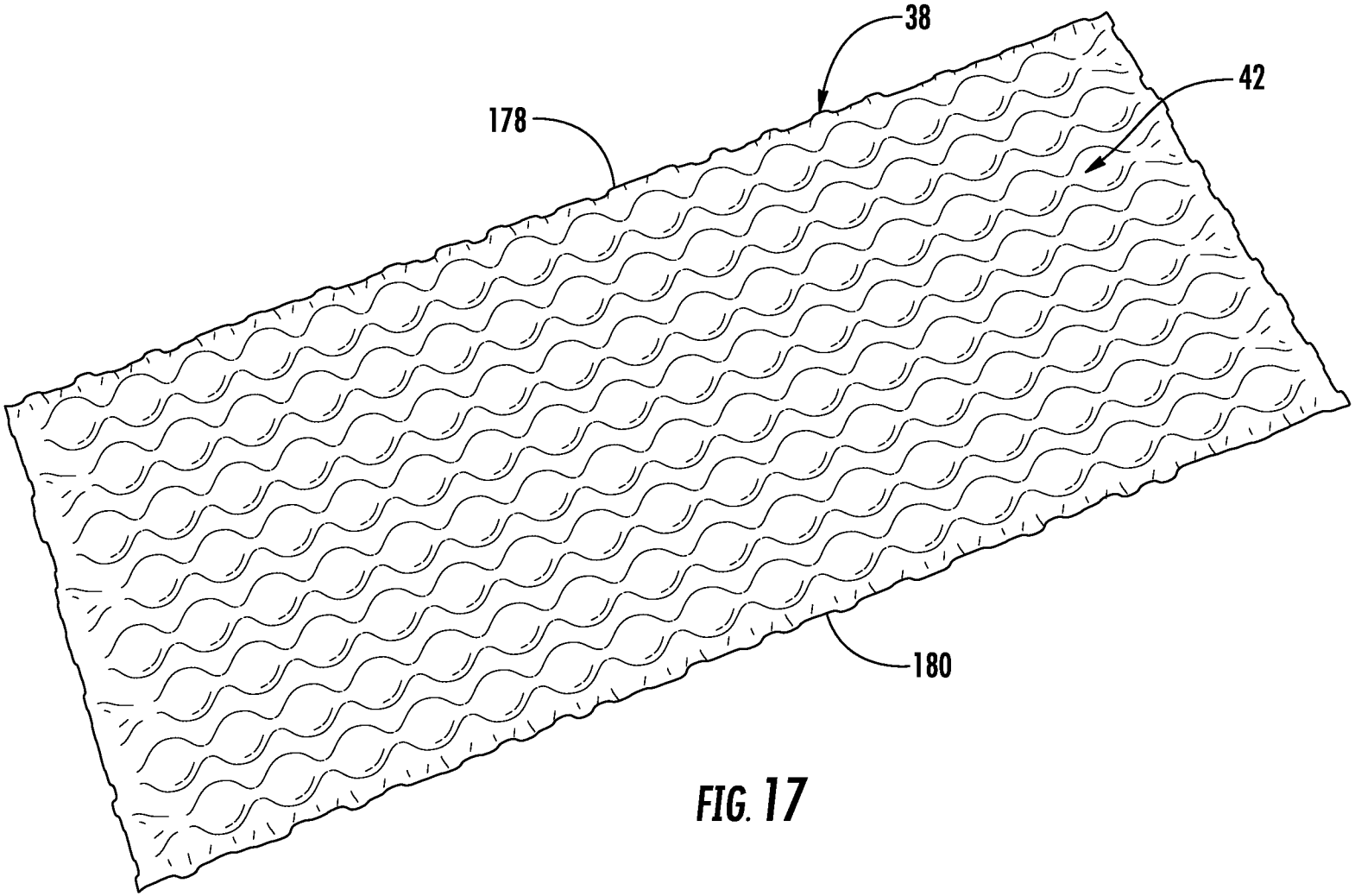
FIG. 17 is a perspective view of a sheet 38 cushioning product made by the machine of FIG. 1.

The cushioning products that may be manufactured by one or more embodiments of the machine may have the configuration selected from one or more of pouches (e.g., pouches 30 and 32 of FIGS. 13-14, respectively), strings of pouches (e.g., string of pouches or multiple pouch string 34 of FIG. 15), corner protectors (e.g., corner protector 36 of FIG. 16), and sheets (e.g., sheet 38 of FIG. 17).

Supply

The machines of the presently disclosed subject matter manufacture the cushioning products from a supply 12 of a web material 40. The web material 40 has sequential transverse rows 42 of inflated protrusions 44, such as rows of inflated "bubbles" for example, web materials as described in one or more of U.S. Pat. Nos. 6,800,162; 6,982,113; 7,220,476; 8,567,159; 8,978,345; and 8,991,141; each of which is incorporated in its entirety by reference. The inflated protrusions 44 along each transverse row 42 are in fluid communication with each other, such that the row may be inflated or deflated at one location.

The supply 12 may be in the form of a roll 46. The supply 12 may be provided from a storage bin or similar container (not illustrated) having an accumulation of the web material. The supply 12 may be provided from a machine (not illustrated) that manufactures the web material 40, for example, feeding directly to machine 10 as that machine demands it. Such machines for manufacturing the web material 40 are described in the previously incorporated references.

Feed Members

Figure 3:
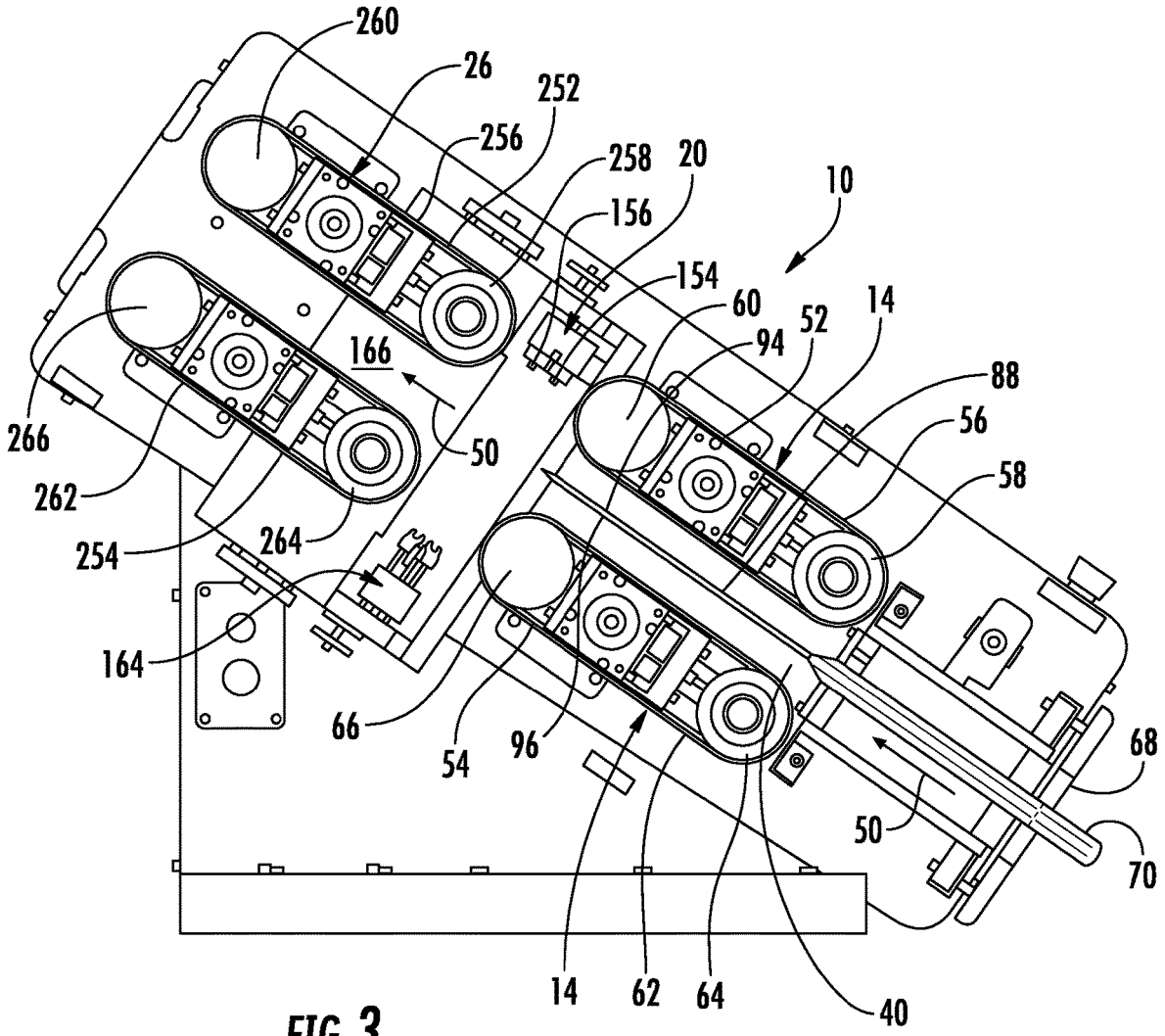
FIG. 3 is a representative sectional view taken along the line 3-3 of FIG. 2.
Figure 5:
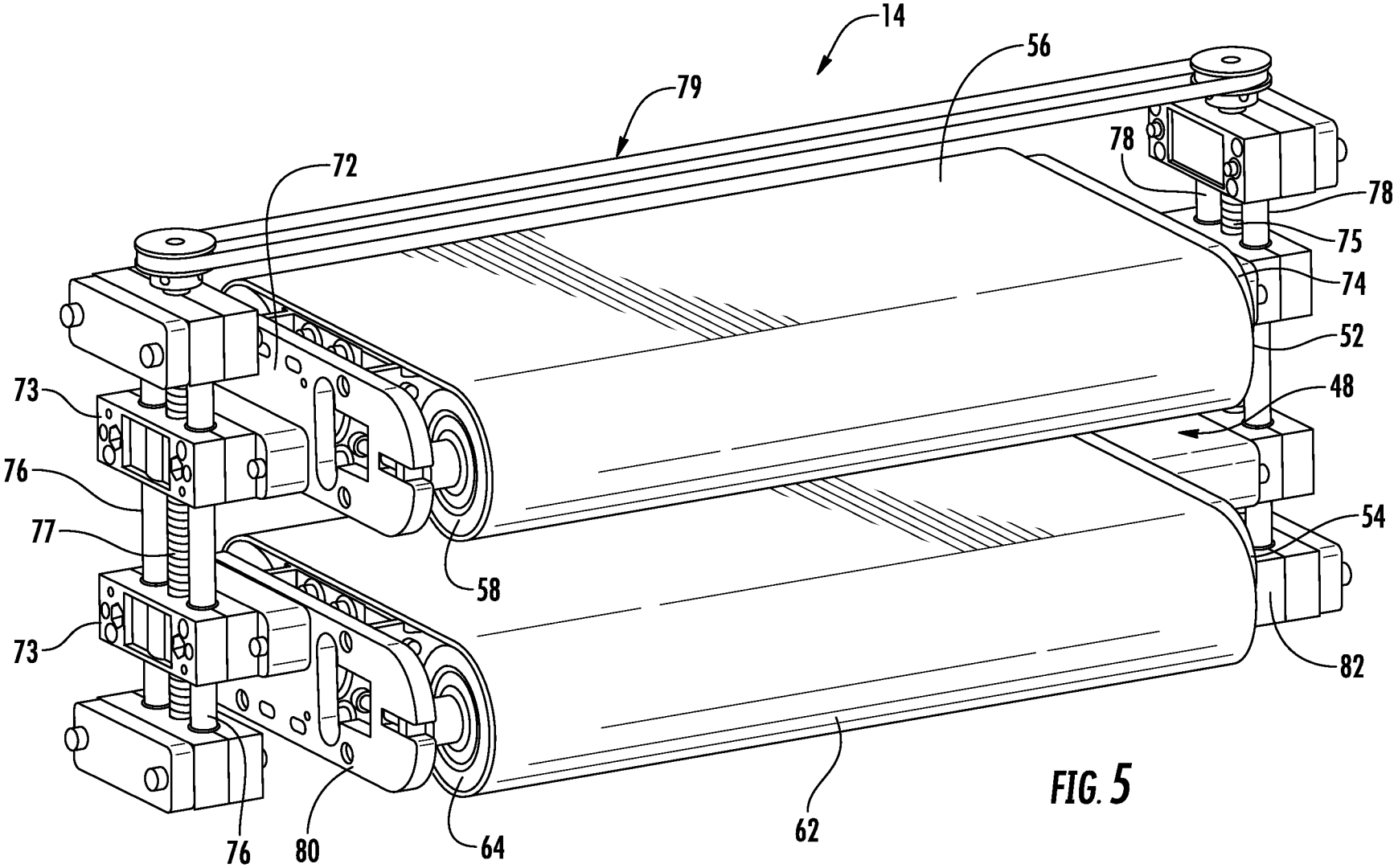
FIG. 5 is a representative detail perspective view of the pair of opposing counter-rotating feed members of the machine of FIGS. 2-3.

A pair of counter-rotating feed members 14 form feed nip 48 therebetween to receive the web material 40 and move it through the feed nip 48 from the supply 12. (FIGS. 3, 5.) The feed members 14 convey the web 40 in the machine direction along a path of travel 50. The feed members 14 include nip 48 between top rotating member 52 and opposing bottom rotating member 54. As illustrated, the top rotating member 52 has upper conveying endless belt 56 around the top upstream driven roller 58 and top downstream driving roller 60, which provides the motive force to rotate the top member 52. The bottom rotating member 54 has bottom conveying endless belt 62 around the bottom upstream driven roller 64 and bottom downstream driving roller 66, which provides the motive force to rotate the bottom member 54.

The top and bottom feed rotating members 52, 54 counter-rotate to provide the conveying force to the web 40, which is controlled in the feed nip 48 formed by the upper and bottom belts 56, 62, to convey the web in the machine direction along the path of travel 50 of the web and also to control the speed of the web. Each of the top rotating member 52 and the bottom rotating member 54 may be independently driven and controlled so that the relative speed of rotation of the top and bottom rotating members may be different relative each other.

The top rotating member 52 is rotatably mounted to left and right top frames 72, 74, which are vertically adjustably mounted to and supported by left and right columns 76, 78, respectively, for example via a linear-motion bearing 73. The bottom rotating member 54 is rotatably mounted to left and right bottom frames 80, 82, which are vertically adjustably mounted to and supported by left and right columns 76, 78, respectively, for example via a linear-motion bearing (not visible). The distance of the gap (i.e., nip 48) between the top and bottom feed members 52, 54 may be adjusted by vertically adjusting the frames along the columns 76, 78. The left linear actuator 77 and right linear actuator 75 (each including a rotating threaded rod and non-rotating threaded nut that travels along the rod as the rod rotates), which are powered by belt and pulley system 79 from an energy source (not shown), may be used to adjust the spacing between the top and bottom rotating feed members 52, 54 by raising and lowering them while also keeping them centered. In this manner, the size of the nip 48 may be adjusted to accommodate control of more than one size of inflated protrusions of web 40, in particular as web 40 may be folded over on itself, as described herein.

Although feed members 14 are illustrated as counter-rotating belts, other types of counter-rotating members that may be useful include segmented belts and rollers (e.g., compliant rollers).

Forming Plow

Figure 4:
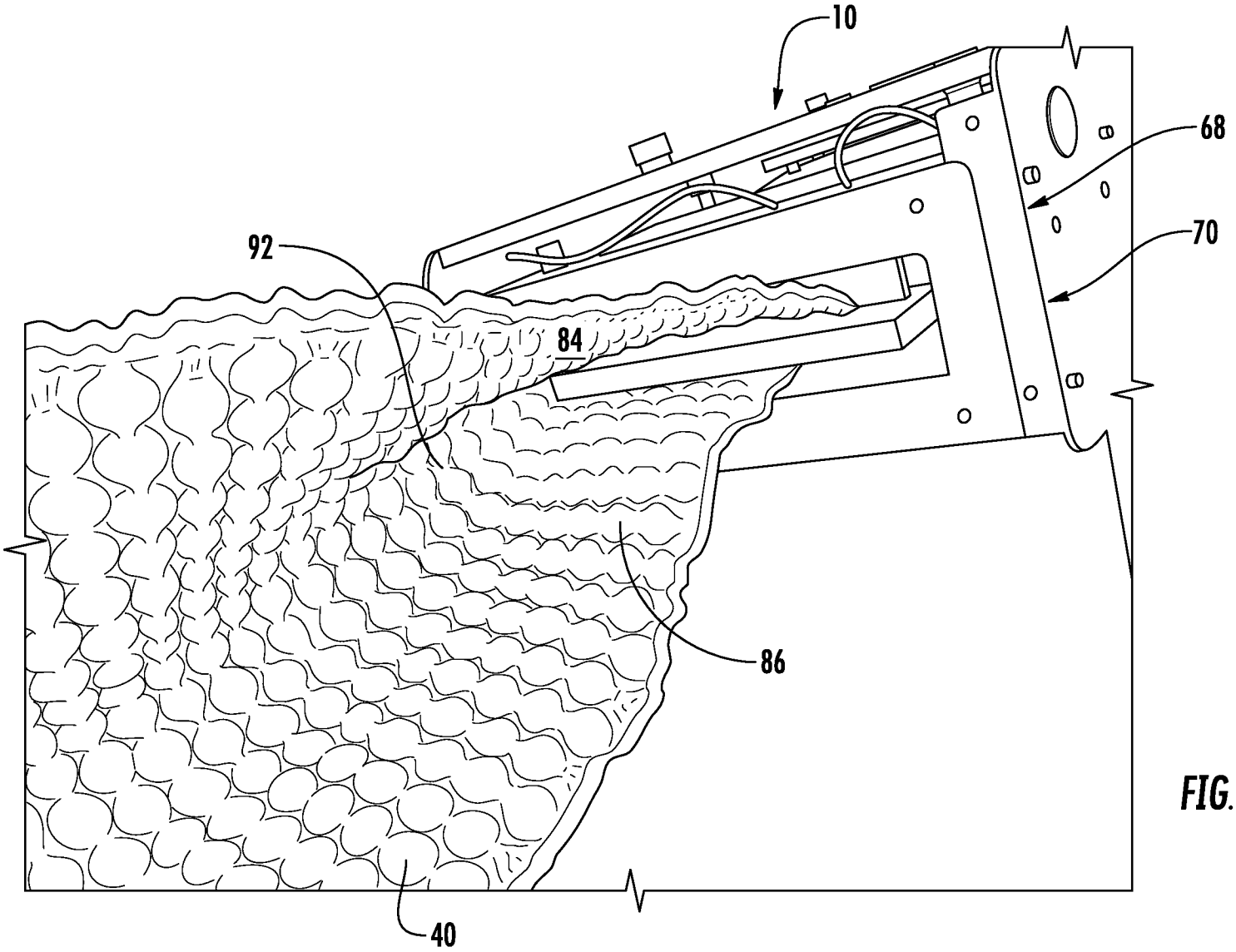
FIG. 4 is a perspective view of the inlet of the machine of FIG. 1 with a web of material.

The web 40 enters machine 10 at inlet 68 as the web is conveyed by the pair of feed members 14. (FIG. 4.) For some configurations of cushioning product (e.g., those having top and bottom panels), machine 10 may include forming plow 70 upstream from the pair of feed members 14 and along the path of travel 50. (FIGS. 3-4.) Forming plow 70 is configured to fold the web 40 longitudinally to juxtapose a top panel 84 of web 40 over a bottom panel 86 of web 40. In the illustrated configuration, forming plow 70 is in the shape of a ledge about which the web is folded longitudinally so that folded edge 92 of the web wraps about the edge of the forming plow 70. The forming plow 70 may be adjustable relative the web 40 and its path of travel 50 to accommodate differing alignments of the two longitudinal unfolded edges of the top and bottom panels 84, 86 of the folded web. The folding plow may thus accommodate a folding configuration where the edges of the web are aligned (i.e., are even with each other) or a folding configuration where one panel may extend farther transversely than the other to provide a fin or closure flap 98 of a desired width in the cushioning product. The folding plow can also accommodate varying widths of web material by moving edge guides (not visible) in or out depending on the desired width.

Separator plate 88 may be used downstream from the forming plow 70 to facilitate management of the web by continuing the separation of the top and bottom panels 84, 86 during conveyance. The separator plate 88 extends along the path of travel 50 and is configured to have top panel 84 and bottom panel 86 on opposing sides. The separator plate 88 may be within feed nip 48 between the top and bottom rotating members 52, 54 so that the top panel 84 of the web may travel between the top rotating member 52 and the separator plate 88, and the bottom panel 86 of the web may travel between the bottom rotating member 54 and the separator plate 88, with the folded edge 92 extending across an edge of the separator plate.

Sensor

The machine 10 includes at least one sensor adapted to detect location information for the sequential rows 42 of inflated protrusions 44 as the web travels along the path of travel 50. As illustrated, machine 10 includes top sensor 94 installed on the top side of separator plate 88 and bottom sensor 96 installed on the bottom side of separator plate 88. (FIG. 3.) Top sensor 94 detects location information for the sequential rows 42 of the top panel 84 and bottom sensor 96 detects location information for the sequential rows 42 of the bottom panel 86. In this embodiment, the sensors 94, 96 are installed to be stationary relative the path of travel 50 and the movement of the web 40 thereon.

Exemplary sensors 94, 96 include one or more of a mechanical sensor, an optical sensor, an ultrasonic sensor, a magnetic sensor, a force sensor (i.e., a force-sensitive resistor or FSR), and a drive current use monitor. As illustrated in FIG. 3, the sensors are a force sensor, such as that available from Interlink Electronics Corp. under the Model 408 FSR trade name. For a mechanical sensor embodiment (not illustrated), a mechanical sensor rides on the top of the web material 40 to move up and down as the inflated protrusions 44 pass by. This up and down motion is detectable, for example, by an encoder, variable resistor, or flex sensor. For an optical sensor embodiment (not illustrated), the sensor looks at the web material 40 and discerns the pattern of protrusions 44 as the material passes by. Another type of sensor is a "speed bump" detection (not illustrated) in which the electrical current use of drive motor is monitored while the web material passes over a raised area (i.e., "bump"). The interaction between the protrusions 44 and the bump causes an increase in drive current.

Piercing Element

Figure 6:
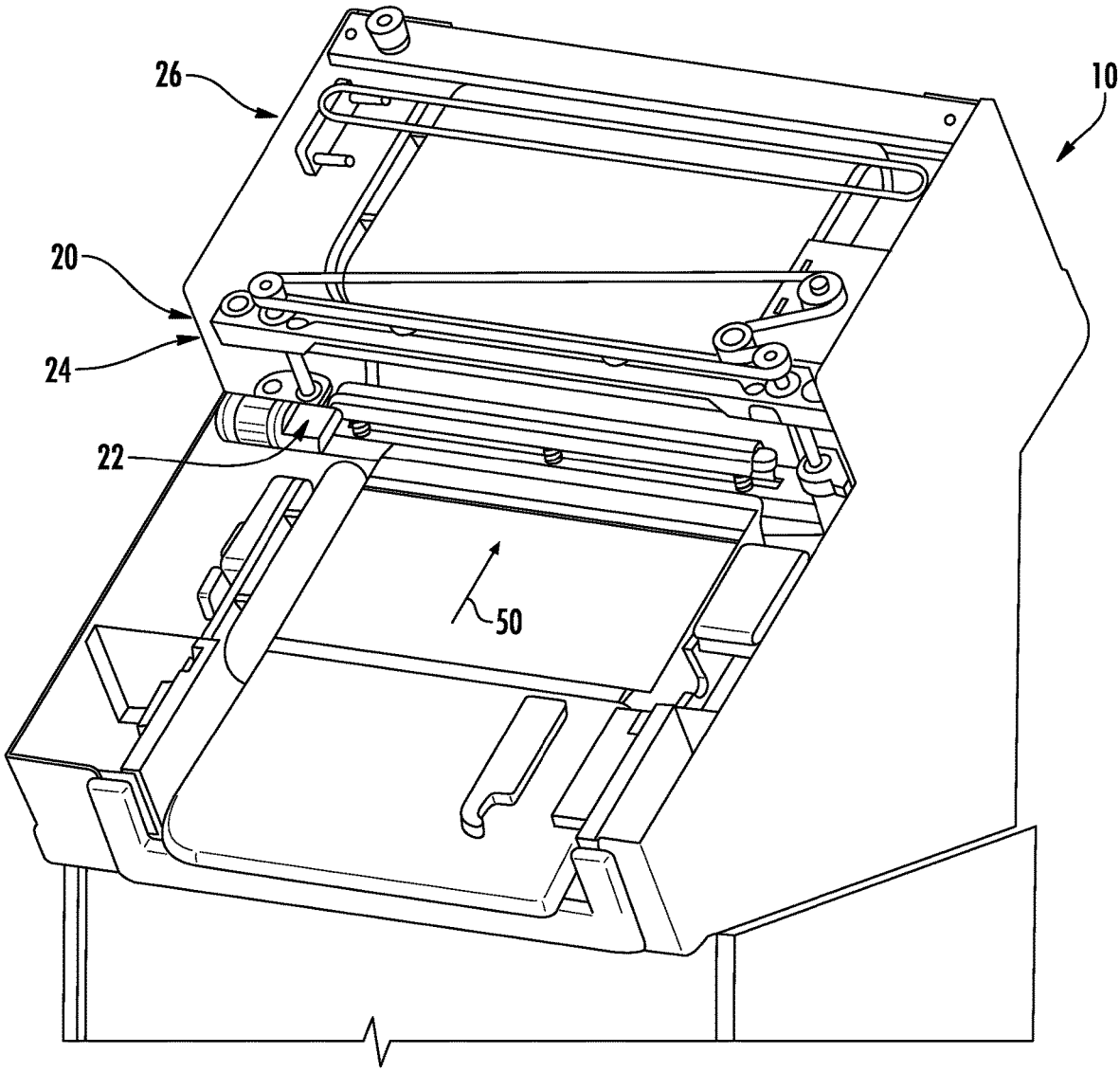
FIG. 6 is a representative perspective view of a portion of the machine similar to that of FIG. 2, but having the feed members removed.
Figure 25:
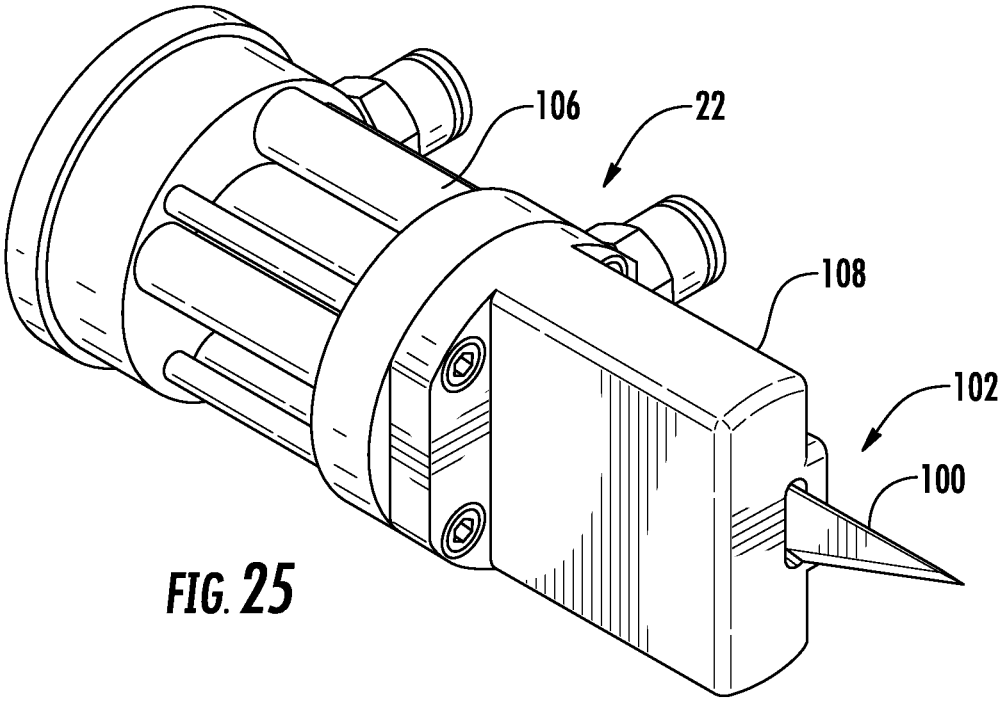
FIG. 25 a representative detail perspective view of the piercing element 22 of the machine of FIG. 6 in the engaged position.
Figure 26:
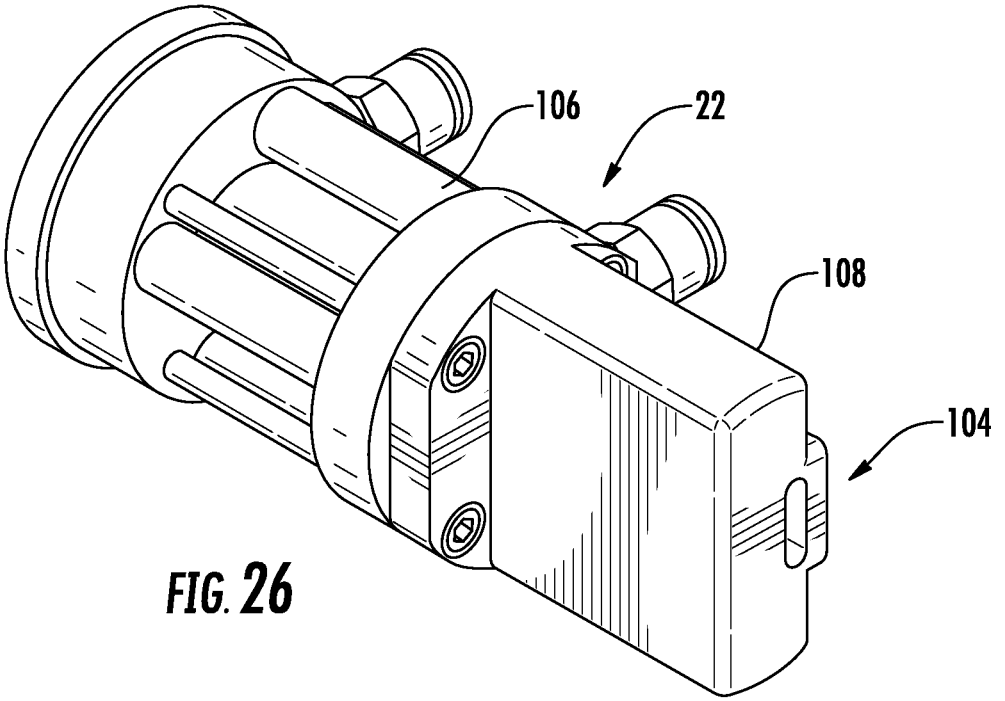
FIG. 26 a representative detail perspective view of the piercing element 22 of the machine of FIG. 6 in the disengaged position.

The machine 10 may include piercing element 22 along the path of travel 50. (FIGS. 6, 25-26.) Piercing element 22 includes a piercing blade 100 that is moveable (e.g., actuatable) between (i) an engaged position 102 (FIG. 25) in which the piercing blade can pierce a transverse row 42 having inflated protrusions 44 and (ii) a disengaged position 104 (FIG. 26) in which the piercing blade 100 is not in a configuration or position to pierce the web (e.g., is in a retracted position).

The piercing of a selected row by the piercing blade 100 creates an outlet opening or hole through which the gas (e.g., air) within the selected row can escape to allow the inflated protrusions 44 of the selected row to collapse or deflate. As used herein, "piercing blade" includes any configuration of a piercing implement having a cutting edge (as in a knife), a cutting tip, or a cutting point (as in a pin or dagger). As illustrated, piercing element 22 includes piercing blade 100 that is moveable from the disengaged position 104, where piercing blade 100 is retracted within housing 108, to the engaged position 102, where piercing blade 100 extends from housing 108. Piercing blade 100 is moveable (i.e., actuatable) between the engaged and disengaged position by actuator 106 attached to housing 108.

Severing and Sealing Devices

Figure 7:
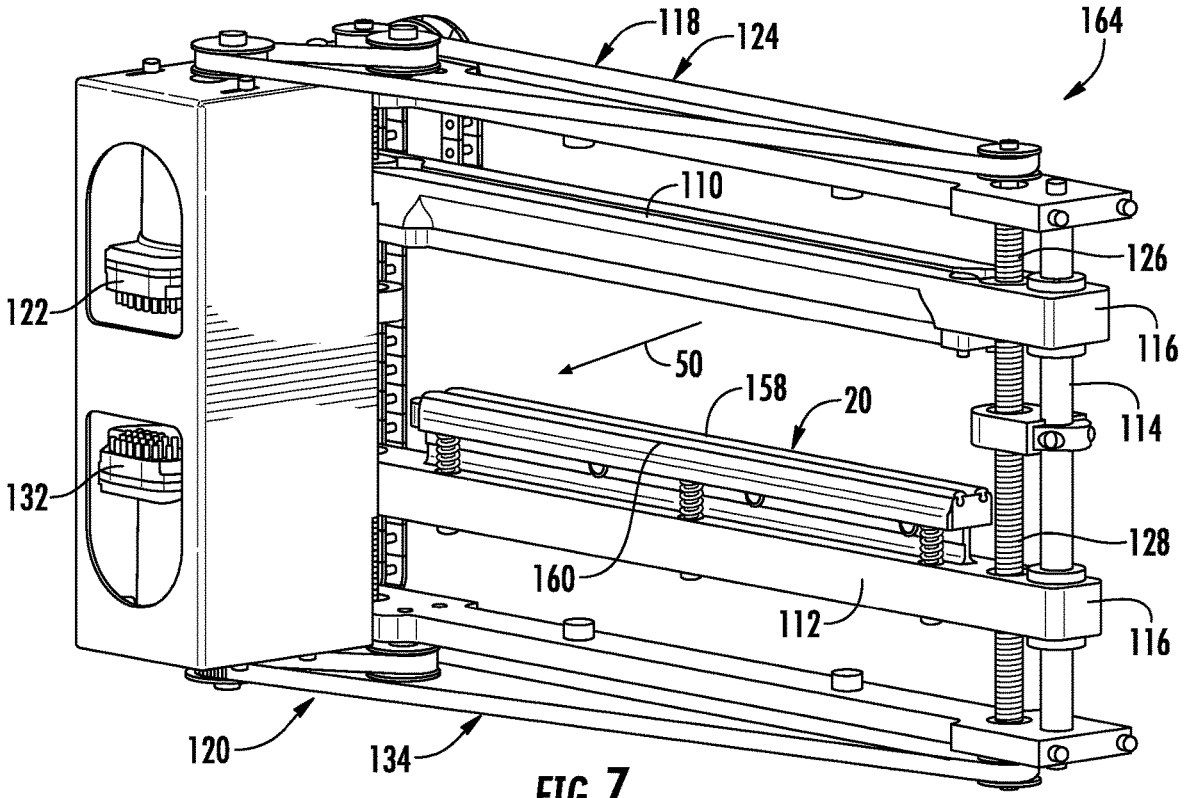
FIG. 7 is a representative detail perspective view of the sealing and severing devices of the machine of FIGS. 2-3, in the disengaged positions.
Figure 8:
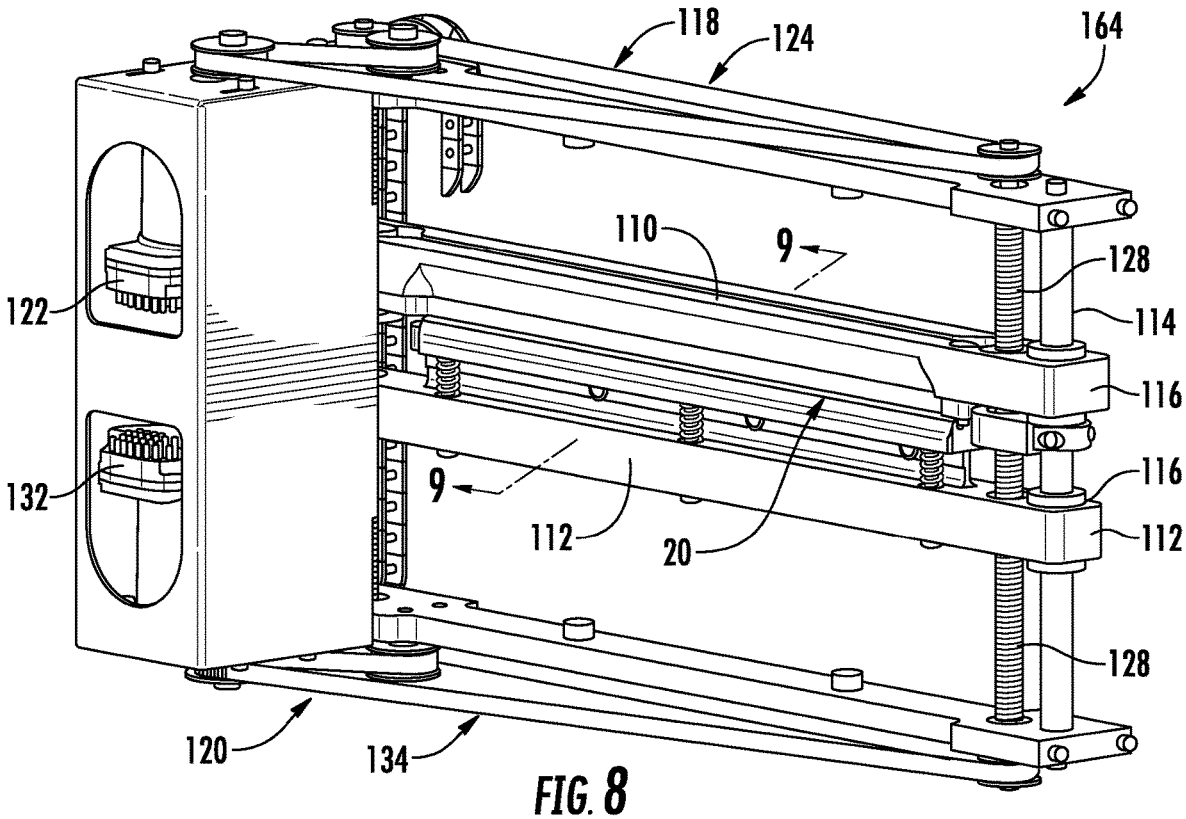
FIG. 8 is a representative detail perspective view of the sealing and severing devices of the machine of FIG. 7, but in the engaged positions.
Figure 9:
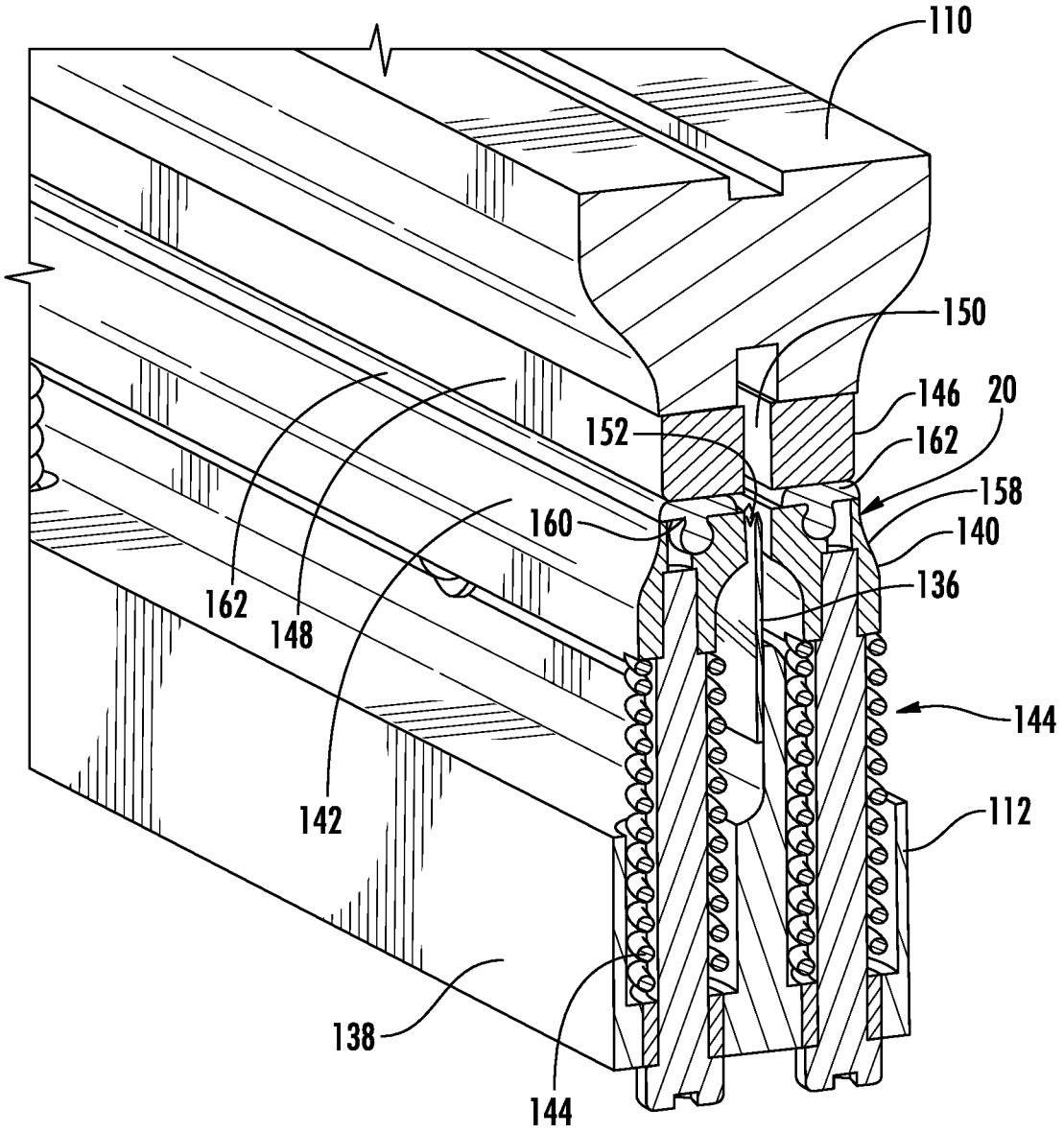
FIG. 9 is a representative perspective sectional view taken along the line 9-9 of FIG. 8.

Machine 10 includes top jaw 110 and opposing bottom jaw 112. (FIGS. 7-8.) Top jaw 110 is slidably supported on the left end by left column 114 via a linear-motion bearing (bearing slide) 116, and on the right end by a similar right column and bearing slide (both not visible), which are on opposing sides of the path of travel 50. Bottom jaw 112 is slidably supported on the left end by left column 114 via a linear-motion bearing 116 and on the right end by a right column and bearing slide (both not visible). The top and bottom jaws 110, 112 are moveable from the disengaged jaw position of FIG. 7 to the engaged jaw position of FIG. 8 by top jaw actuator system 118 and bottom jaw actuator system 120.

Top jaw actuator system 118 controls the movement of the top jaw 110 and includes top motor 122 providing rotation energy via top belt and pulley system 124 to (i) a top left linear actuator 126 on the left end of top jaw 110 and (ii) a top right linear actuator (not visible) on the right end of top jaw 110.

Bottom jaw actuator system 120 controls the movement of the bottom jaw 112 and includes bottom motor 132 providing rotation energy via belt and pulley system 134 to (i) a bottom left linear actuator 128 on the left end of bottom 112 and (ii) a bottom right linear actuator (not visible) on the right end of bottom jaw 112.

The top and bottom, left and right linear actuators as illustrated are of the type having a rotating threaded rod and non-rotating threaded nut that travels along the rod as the rod rotates. The use of other types of linear actuators are within the scope of this disclosure.

Severing device 20 includes severing blade 136 mounted to the base 138 of bottom jaw 112 between bottom upstream portion 140 and bottom downstream portion 142 of bottom jaw 112. The severing blade 136 extends transversely across the path of travel 50 so that the blade is capable of separating the web transversely. The upstream portion 140 and downstream portion 142 are moveably supported by springs 144. Severing device 20 also includes the top upstream portion 146 and top downstream portion 148 of top jaw 110 which are separated by gap 150 creating a void within the top jaw 110 sufficient to receive the severing blade 136.

Figure 10:
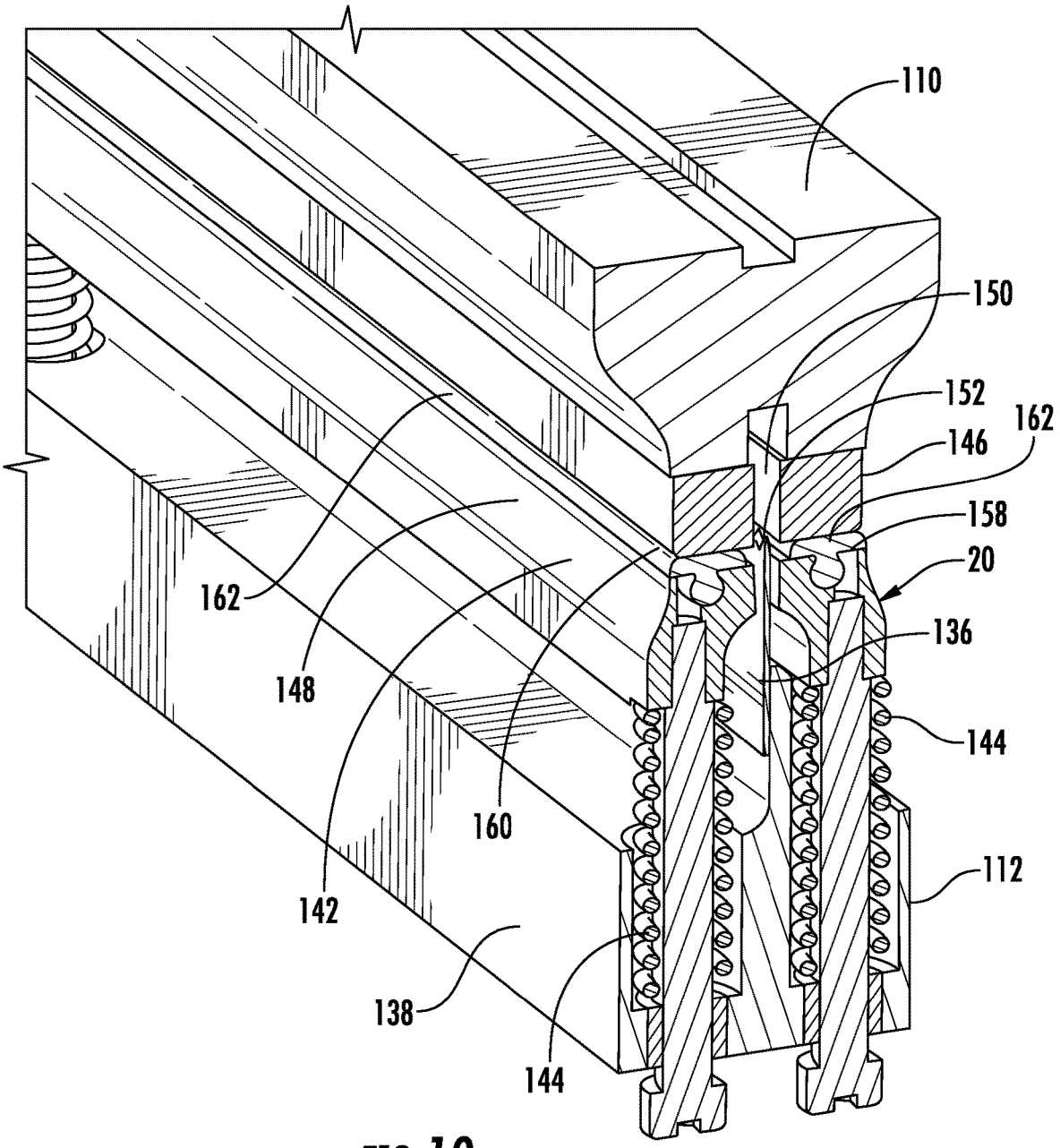
FIG. 10 is a representative perspective view similar to that of FIG. 9, but having the severing device in the engaged position to perforate a web.

The severing device 20 is moveable between a disengaged position (FIG. 9), in which the severing device does not (i.e., is not configured to) engage the web 40 to separate or perforate the web, to an engaged position (FIGS. 10-11), in which the severing device contacts (i.e., is configured to contact) the web 40 to perform one or more of (i) separating the web transversely across the web 40 (FIG. 11) or (ii) perforating the web 40 transversely across the web (e.g., to create a perforated line of detachment across the web) (FIG. 10).

In the illustrated embodiment of machine 10, the severing blade 136 has a serrated cutting edge 152 adapted to separate the web transversely or to perforate the web transversely depending on the depth of penetration into the web when the severing device is in the engaged position. In more detail, bottom jaw 112 includes springs 144 that are biased to hold the upstream and downstream portions 140, 142 of the bottom jaw 112 upward so that the severing blade 136 does not extend above the surface of the bottom jaw 112. Thus, in the disengaged position of severing device 20, although the top jaw 110 (e.g., top upstream and downstream portions 146, 148) may contact the bottom jaw 112 (e.g., bottom upstream and downstream portion 140, 142), the top jaw 110 does not compress the springs 144 and the severing blade 136 does not extend above the surface of the bottom jaw.

Figure 11:
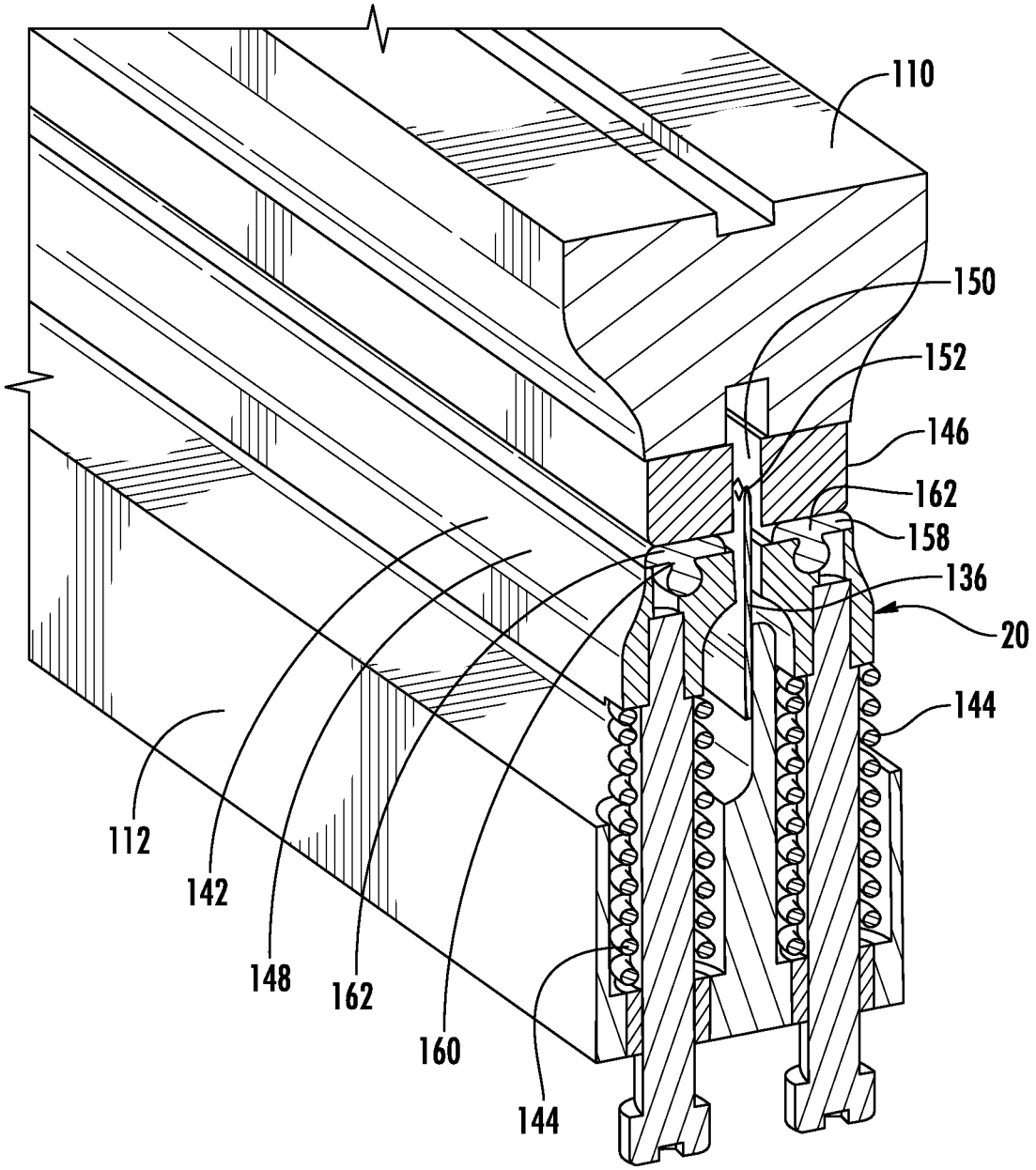
FIG. 11 is a representative perspective view similar to that of FIG. 10, but having the severing device in the engaged position to separate a web.
Figure 12:
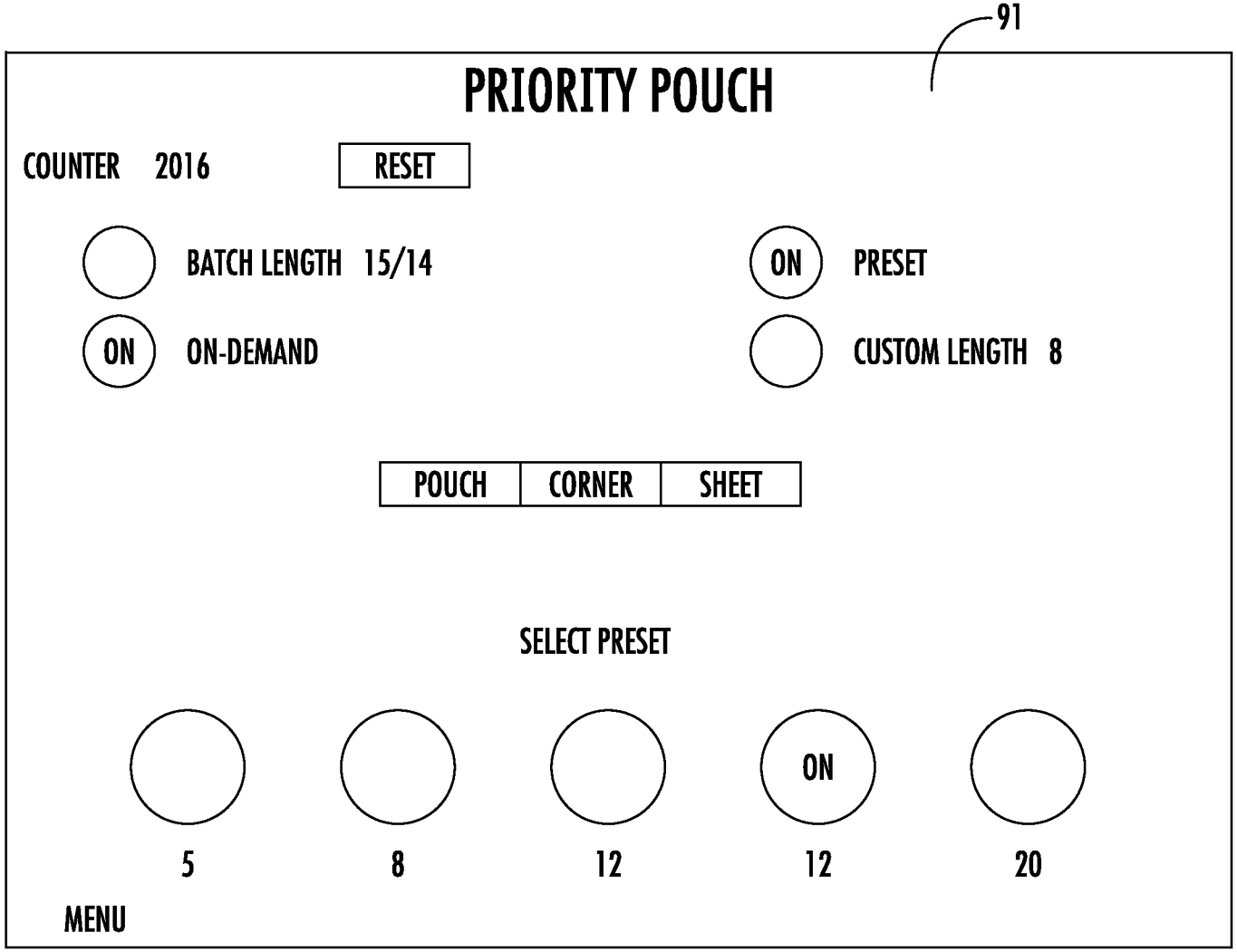
FIG. 12 is a screen shot of the control panel 91 of the machine of FIG. 1.

The severing device 20 may be selectively placed into the engaged position by moving the top and bottom jaws relative each other so that the top jaw contacts the bottom jaw to compress the springs 144 so that at least a portion of the blade 136 extends above the surface of the bottom jaw 112 and into the gap 150. Accordingly, in this position the blade 136 will contact the web 40 that it is compressed between the top and bottom jaws. The severing device may selectively perform the perforation of the web by moving the top and bottom jaws only so much as to compress springs 144 to reveal the serrations of the serrated edge 152 above the surface of the bottom jaw and into the gap 150 (i.e., the perforation position). (FIG. 10.) The severing device may selectively perform the separation of the web transversely by moving the top and bottom jaws enough to compress springs 144 so that the complete cutting edge of the severing blade 136 (i.e., the points and the valleys of the serrated edge) above the surface of the bottom jaw and into the gap 150. (FIG. 11.)

Although severing device 20 has been described above in terms of a blade, other implements for cutting are within the scope, such as a heating element (e.g., a resistive wire) (not illustrated) adapted to separate the web transversely (i.e., be in the engaged mode) when the heating element contacts the web and is heated (e.g., by the passage of electricity through a resistive wire) sufficiently to cut through the web material. Although the severing blade 136 has been described as mounted on the bottom jaw 112 with the gap 150 in the top jaw 110, this arrangement could be reversed such that the top jaw incorporates the severing blade and related features, while the bottom jaw has the gap 150.

Machine 10 includes sealing device 24 having at least one sealing element. As illustrated, sealing device 24 includes upstream sealing element 154 on the surface of the top upstream portion 146 of the top jaw 110 and downstream sealing element 156 on the surface of the downstream portion 148 of the top jaw 110. (FIG. 3.) The sealing element may be, for example, a wire that is connected to a selectively operable energy source (not shown) to heat the wire to a heated condition, which has a suitable temperature to seal the top panel 84 and the bottom panel 86 together. Suitable wires for heat sealing are known in the art, such as wires comprising nichrome or other suitable resistive metals or alloys thereof. Each of the sealing elements 154, 156 are independently selectively operable to the heated condition to perform the sealing function. The distance between the upstream sealing element 154 and the downstream sealing element 156 may be set to be no greater than the width of the selected row, for example, the width after such selected row has been pierced, deflated and flattened as illustrated by row 168 of FIG. 18.

The sealing device 24 also includes at least one backing element opposing the at least one sealing element. The bottom upstream portion 140 of the bottom jaw 112 serves as upstream backing element 158 that opposes the upstream sealing element 154. The bottom downstream portion 142 of the bottom jaw 112 serves as downstream backing element 160 that opposes the downstream sealing element 156. The surface of the upstream and downstream backing elements may comprise resilient material 162 to facilitate the heat sealing process, such resilient backing materials being known in the art.

Each of the opposing upstream sealing and backing elements 154, 158 and the opposing downstream sealing and backing elements 156, 160 are on opposite sides of the path of travel 50 of web 40. Each of the opposing sealing and backing elements are selectively moveable relative each other between an engaged position (FIGS. 9-11), in which the sealing and backing elements compress the top and bottom panels 84, 86 of web 40 in a selected region to heat seal the top and bottom panels together, and a disengaged position (FIG. 3), in which the opposing sealing and backing elements are not in the engaged position (e.g., are spaced apart).

The sealing device 24 may be selectively operable to an upstream seal mode in which the upstream sealing element 154 and the upstream backing element 158 are in the engaged position having the upstream sealing element 154 in the heated condition to create a lead transverse heat seal 174 across the folded web 40 to join the top panel 84 to the bottom panel 86. The sealing device 24 may be selectively operable to a downstream seal mode in which the downstream sealing element 156 and the downstream backing element 160 are in the engaged position having the downstream sealing element 156 in the heated condition to create a trailing transverse heat seal 176 across the folded web 40 to join the top panel 84 to the bottom panel 86.

To be clear, the upstream sealing element 154 and the upstream backing element 158 may be in contact with each other but not be in the "engaged position" as used herein unless the upstream sealing element 154 is in the heated condition to create a heat seal. Likewise, the downstream sealing element 156 and the downstream backing element 160 may be in contact with each other but not be in the "engaged position" as used herein unless the downstream sealing element 156 is in the heated condition to create a heat seal. This feature allows the top and bottom jaws to be "closed" to contact each other; however, the lead or trailing heat seals may both be made, one or the other made, or neither made, depending on whether the respective sealing element is activated to the heated condition while the jaws are closed.

Although the sealing elements have been described as positioned on the top jaw 110 and the backing elements associated with bottom jaw 112, one or both of the sealing elements and the respective backing element could be in the reverse orientation.

The severing device 20 may be downstream from the upstream sealing element 154 and upstream from the downstream sealing element 156, as illustrated in the drawings. In this configuration, the sealing device and severing device can cooperate to transversely separate the web between a lead transverse seal and a trailing transverse seal. If the sealing device 24 includes only one sealing element, then the severing device may be configured to sever and separate the web transversely in the heat sealed region to separate the web into a lead transverse seal and a trailing transverse seal created from the one heat sealed region.

The severing and sealing devices 20, 24 may be integral with each other (i.e., an integral severing/sealing device 164) as illustrated in the drawings, having the severing device 20 and the sealing device 24 both utilizing the same opposing jaw systems. Further, the integral severing/sealing device may include a heating element adapted to simultaneously separate the web transversely and heat seal the top and bottom panels of the web together when the severing/sealing device is in the engaged position. (Not illustrated.)

Useful sealing and severing technologies are described, for example, in one or more of U.S. Pat. Nos. 5,376,219; 5,942,076; 6,003,288; 7,389,626; 8,567,159; and U.S. Pat. App. Publ. 2014/0314978 A1; each of which is incorporated herein in its entirety by reference.

Outfeed Members

A pair of counter-rotating outfeed members 26 form outfeed nip 166 therebetween to receive the web material 40 downstream from the severing device 20 and move the web through the outfeed nip 166. (FIGS. 3, 6.) The outfeed members 26 convey the web 40 in the machine direction along path of travel 50. The outfeed members 26 include nip 166 between between top rotating member 252 and opposing bottom rotating member 254. As illustrated, the top rotating member 252 has upper conveying endless belt 256 around the top upstream driven roller 258 and top downstream driving roller 260, which provides the motive force to rotate the top member 252. The bottom rotating member 254 has bottom conveying endless belt 262 around the bottom upstream driven roller 264 and bottom downstream driving roller 266, which provides the motive force to rotate the bottom member 254.

The top and bottom feed rotating members 252, 254 counter-rotate to provide the conveying force to the web 40, which is controlled in the outfeed nip 166 formed by the upper and bottom belts 256, 262, to convey the web in the machine direction along the path of travel 50 of the web and also to control the speed of the web. Each of the top rotating member 252 and the bottom rotating member 254 may be independently driven and controlled so that the relative speed of rotation of the top and bottom rotating members may be different relative each other.

The top and bottom rotating outfeed members 252, 254 may be rotatably mounted and supported in a similar manner as that described herein with respect to the feed members 52, 54. Accordingly, the distance of the gap (i.e., nip 166) between the top and bottom outfeed members 252, 254 may be adjusted in a manner similar to that described herein with respect to the feed members 52, 54, to accommodate control of more than one size of inflated protrusions of web 40, in particular as web 40 may be folded over on itself, as described herein.

Controller

Controller 90 (FIGS. 1, 24) may comprise one or more of a microprocessor; a central processing unit (CPU); an integrated circuit; memory; computer programming code; printed circuit assembly, e.g., a printed circuit board (PCB), and include a control unit (e.g., an electronic controller) such as a microcontroller, which stores pre-programmed operating codes; programmable logic controller (PLC); programmable automation controller (PAC); a personal computer (PC); or other such control device which is capable of receiving both operator commands and electronic, sensor-generated inputs, and carrying out predetermined (e.g., pre-programmed) operations based on such commands and inputs. Programming commands may be supplied to the controller 90 via the operator interface or control panel 91 (which as used herein includes any types of control interface, such as a wireless communication device).

Figure 24:
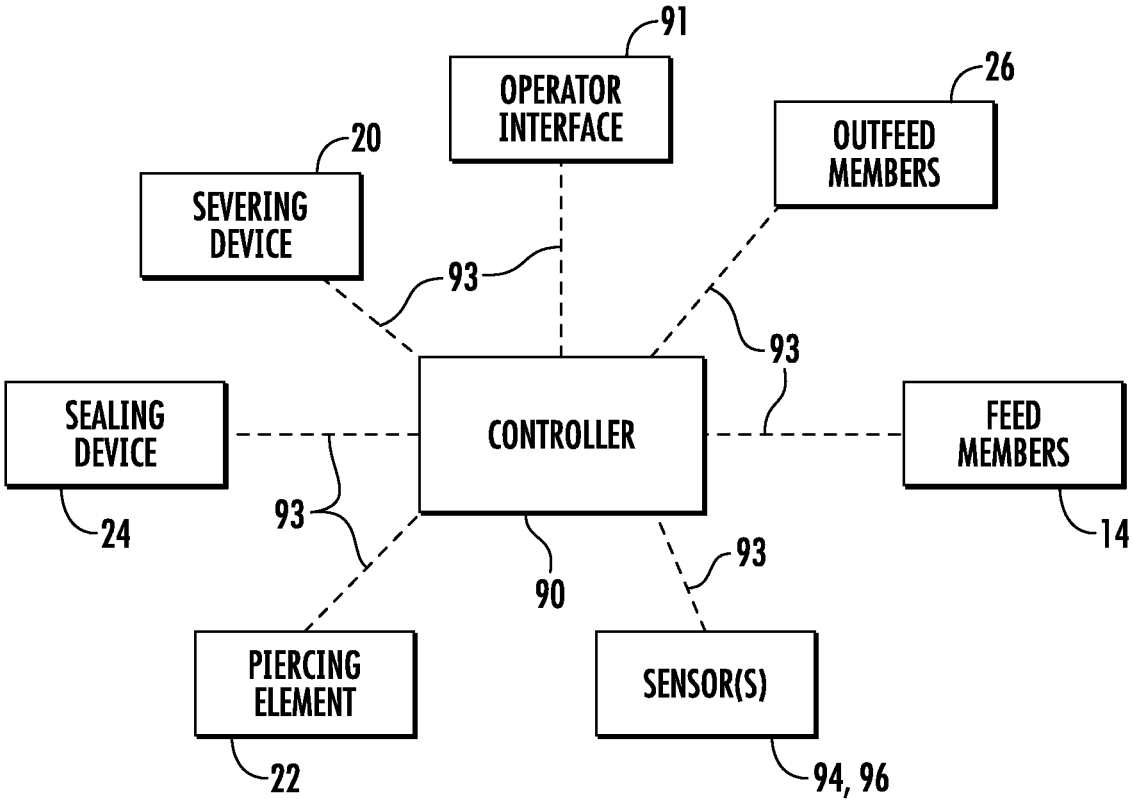
FIG. 24 is a representative schematic of the controller communications and process control for the machine of FIG. 1.

The controller 90 may be in operative communication with and/or operatively control of, one or more of any of the severing device 20, sealing device 24, piercing element 22, sensor(s) 94, 96, feed members 14, outfeed members 26, and the operator interface 91 along lines of communication and/or control 93. (FIG. 24.) The operator interface device 91 (FIGS. 1, 12) may be used to send one or more instructions to the controller 90 regarding the length ("L") of, the number of, and the configuration for, one or more cushioning products, for example, selected from one or more of a pouch 30, a string of pouches 34 (i.e., multiple pouch string) having a desired number of multiple pouch compartments, a corner protector 36, and a sheet 38. The controller 90, in response to those one or more instructions, may operatively control one or more of the severing device 20 (e.g., by controlling the top and bottom motors 122, 132), the sealing device 24 (e.g., by energizing a sealing element 154 or 156), and the pair of feed members 14 (by controlling the rotational speed of the driven rollers). For example, the controller 90 may be programmed to receive instruction from the operator interface device regarding the length ("L") of the desired cushioning product, and operatively control the severing device 20 between its engaged position and its disengaged position (e.g., by controlling the motors 122, 132) and the speed of the pair of feed members 14 (e.g., by controlling the rotational speed of the top and bottom driving rollers 60, 66) in response to the instructions. The interface device 91 may also be used to input to the controller whether to run machine 10 in an "on-demand" mode, in which the machine makes another cushioning product as the previous cushioning product is withdrawn by an operator from the machine, or in a "batch" mode, in which the machine 10 manufactures a selected number of a selected cushioning product.

As web 40 travels through machine 10, the position of each transverse row of the sequential transverse rows 42 of inflated protrusions 44 of the web may be tracked by controller 90. For example, as the rows 42 sequentially pass by sensor 94, the sensor detects the presence of each row. In so doing, each row's location information is also detected, because the initial location of the detected row is the same at the instance of detection as the position of the sensor. The sensor may identify the presence of a row at the location of the sensor, for example, by sensing the peak (e.g., centerline) of an inflated protrusion of the row. The resulting location information is communicated to controller 90.

A system of determining the travel distance of a selected row is also in communication with the controller. For example, one such system includes rotary encoders and digital or electronic counters (not illustrated) associated with the movement of the feed members in communication with the controller 90. This permits the controller 90 to determine the distance of travel of the feed members 52, 54 and therefore the travel distance of the web (and the selected row) that is under control of the feed members. Another such system of determining the travel distance counts the number of the transverse rows that pass the sensor, using that information in conjunction with a known distance between each of the rows of inflated protrusions to calculate the travel distance of the web (and the selected row). The controller may control the travel distance of the web in setting the length of the manufactured cushioning product to the programmed value. Thus, controller 90 may be programmed to use this information, for example, to determine the length of the resulting cushioning product 30, 34, 36, 38. The length "L" of the resulting cushioning product is the longitudinal (machine) distance between a lead transverse seal 174 or lead cut 178 and a trailing transverse seal 176 or trailing cut 180. (FIGS. 19 to 23.)

The controller 90 may also be programmed with the known distances from the sensor to one or more of the severing device 20, sealing device 24, and the piercing element 22. (FIG. 24.) Using this information in conjunction with the travel distance, the controller 90 can determine and/or control (by controlling the movement of the feed members 52, 54 and therefore the web controlled by the feed members) when a selected row is in the correct position (i.e., the "determined position") relative each device to be acted upon by that device (e.g., sealed, severed, or pierced).

Figure 18:
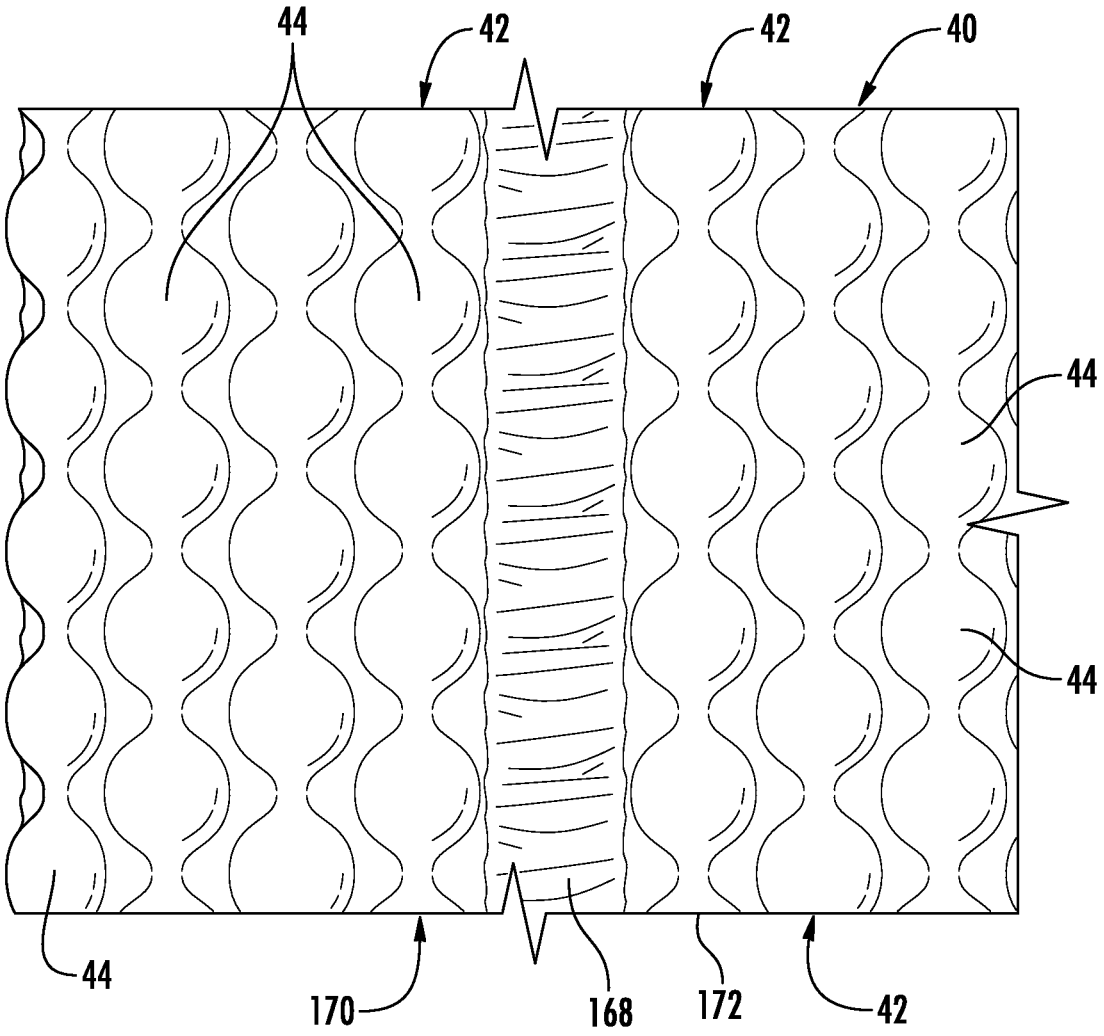
FIG. 18 is a top down plan view of a web of material having a selected row pierced to deflate the protrusions and tensioned to flatten the selected row.
Figure 19:
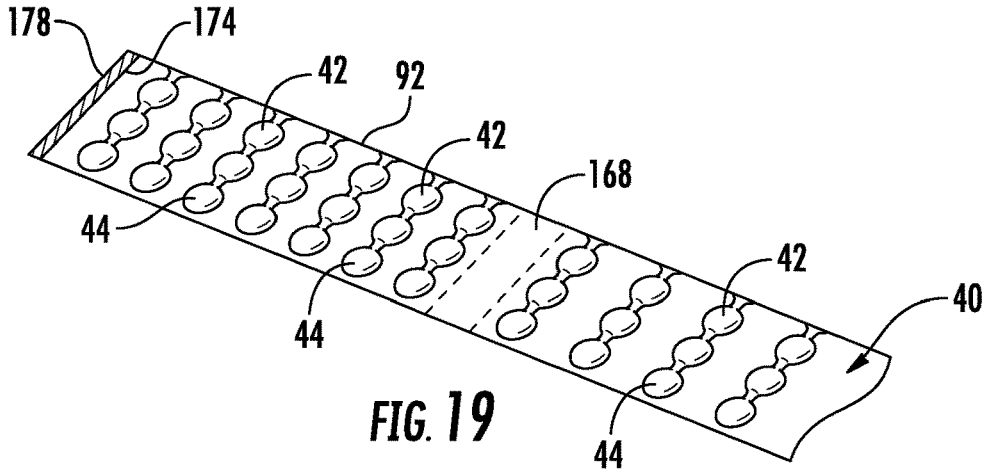
FIG. 19 is a representative perspective view of a web having a selected row pierced to deflate the inflated protrusions.
Figure 20:
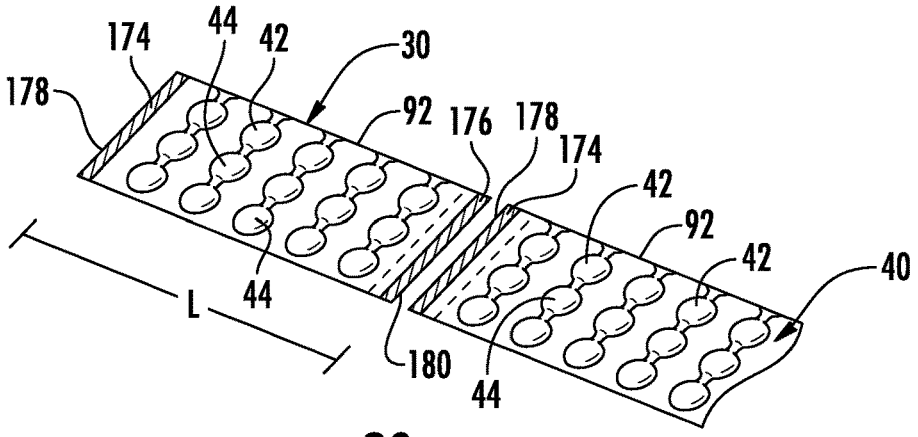
FIG. 20 is a representative perspective view of a web having a pouch cushioning product made from the web by the machine of FIG. 1.
Figure 21:
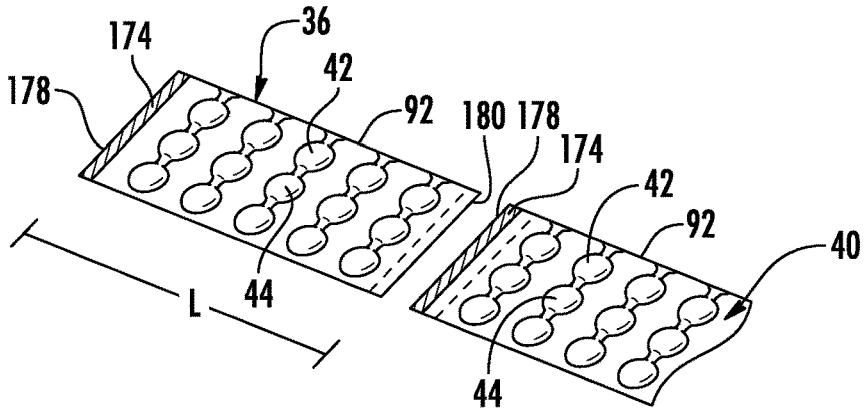
FIG. 21 is a representative perspective view of a web having a corner protector cushioning product made from the web by the machine of FIG. 1.
Figure 22:
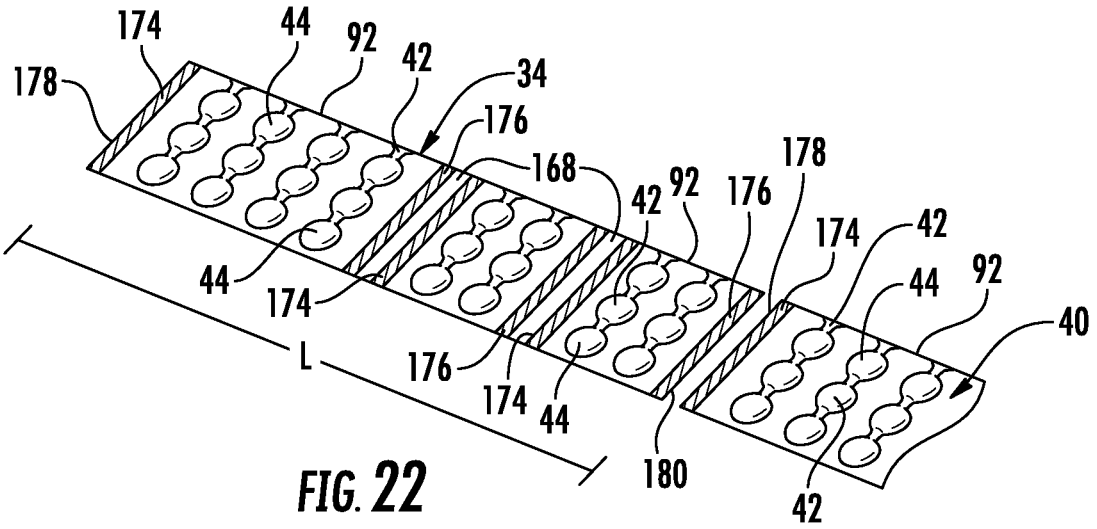
FIG. 22 is a representative perspective view of a web having a string of pouches cushioning product made from the web by the machine of FIG. 1.
Figure 23:
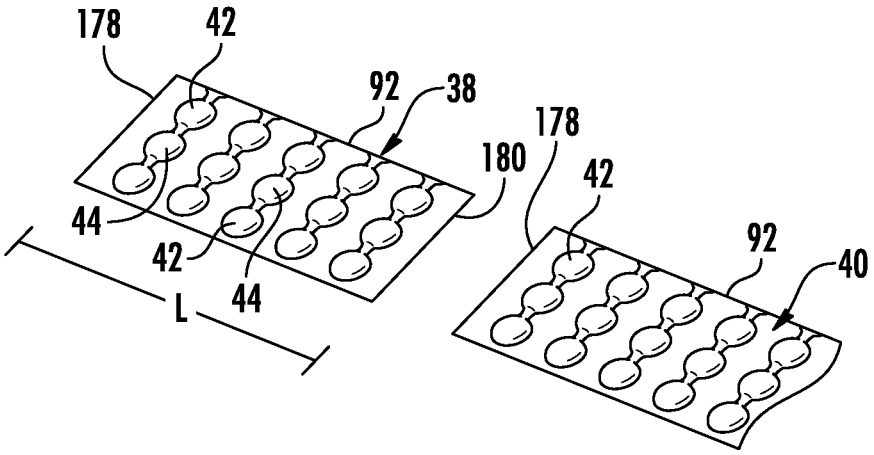
FIG. 23 is a representative perspective view of a web having sheet cushioning product made from the web by the machine of FIG. 1.

In this manner, the operation of a device may occur with reasonable certainty to affect only a specified area (e.g., a selected row) of the web. For example, by deflating a selected row (e.g., row 168 of FIG. 18), the subsequent downstream sealing operation may occur in the specific location of that selected row. This provides the advantage of locating the heat seal in the deflated row, which provides a more effective sealing environment relative an inflated row. Further, the heat seal or seals may be made relatively closely to the inflated rows (e.g., rows 170, 172) that are adjacent the deflated selected row (e.g., row 168). (FIG. 18.) This provides for a more attractive product, more effective heat seals and/or separation cuts or severs.

Further, even if the selected row is not deflated, a heat seal or severing operation may occur in just the area of the selected row with some certainty. Thus, a seal or severing will not occur at a random location along the web relative the location of a row of inflated protrusions, which can result in a heat seal or severing occurring in a manner that could undesirably affect more than one row.

Controller 90 may be programmed (i) to receive the location information detected by the at least one sensor (e.g., sensors 94, 96) and (ii) to operatively control the severing and/or sealing devices 20, 24 so that at least one of the severing and sealing devices is in its engaged position when a selected row is in a determined position relative the respective severing and/or sealing devices. The controller 90 may be programmed to operatively control the counter-rotating speed of the pair of feed members 14 and/or the pair of outfeed members 26, for example by controlling the rotational speed of the one or more driven rollers 58, 64 of the feed members or the driven rollers 258, 264 of the outfeed members. The controller 90 may be programed to receive the location information from the top and bottom sensors 94, 96, to compare that location information, and to operatively control the relative speed of the top rotating member 52 and the bottom rotating member 54 to align the sequential rows 42 of the top panel 84 with the sequential rows 42 of the bottom panel 86 of a folded web 40.

The controller 90 may be programmed to operatively control the piercing element 22 to move it to the engaged position when the selected row is in a determined position relative the piercing element 22. The controller 90 may be programmed to selectively operate the counter-rotating speed of the pair of outfeed members 26 faster than the counter-rotating speed of the pair of feed members 14, for example, to flatten a selected row after it has been pierced. For example, the controller 90 may be programmed to operate the counter-rotating speed of the pair of outfeed members 26 faster than the counter-rotating speed of the pair of feed members 14 at least (i) after the piercing element 22 has pierced the selected row and (ii) before the selected row is in the determined position relative the severing device 20. Also, the controller 90 may be programmed to operate the counter-rotating speed of the pair of outfeed members 26 while the counter-rotating feed members 52, 54 of the pair of feed members 14 are stopped (i) while the selected row is in the determined position relative the severing device 20 and (ii) after the severing blade 136 having a serrated edge 152 has pierced the selected row. In such cases, the machine 10 may thus be adapted to facilitate the flattening of the pierced selected row by the tension created in the web by the differing counter-rotating speeds of the feed and outfeed members 14, 26, creating, for example, the flattened row 168 of FIG. 18.

The controller 90 may be programmed to operatively control and to adjust the relative conveying speed of the feed members 14 (including moving to a stopped conveying speed), thereby controlling the speed and position of the web controlled by the feed members. In so doing, the controller 90 may be programmed to control the conveying speed of the feed members by communication with the one or more motors that drive the feed members.

If the sealing device 24 includes an upstream sealing element 154 and a downstream sealing element 156 as described herein, the controller 90 may be programmed to operatively control the sealing element in an independent and selective manner to a heated condition, and to operatively control the sealing device to an upstream seal mode, a downstream seal mode, or both simultaneously, when the selected row for sealing is in a determined position relative the sealing device 24. Thus, as described herein, the sealing elements 154, 156 and the severing blade 136 may be triggered or actuated independently or in any combination providing in one machine the ability to make pouches, corner cushions, or sheets.

The various aspects of the machine 10 as described herein may provide some advantage in avoiding cutting or sealing through two rows of the inflated protrusion of the web. The machine 10 may provide the ability to create multi-chambered pouches 34 for multiple packing applications. The machine provides for piercing (i.e., popping) the inflated selected row before sealing along that row or severing along that row, which permits the selected row to be deflated and flattened to its uninflated width. The resulting flat row allows a transverse seal to be much closer to the adjacent row of inflated protrusions compared to sealing across an inflated row, thus providing enhanced edge protection.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. The definitions and disclosures set forth in the present Application control over any inconsistent definitions and disclosures that may exist in an incorporated reference. All references to ASTM tests are to the most recent, currently approved, and published version of the ASTM test identified, as of the priority filing date of this application. Each such published ASTM test method is incorporated herein in its entirety by this reference.

What is claimed is:

1. A machine for providing cushioning products of varying lengths from a supply of a web material having sequential transverse rows of inflated protrusions, the machine comprising:

a pair of opposing counter-rotating feed members forming a feed nip therebetween for moving the web through the feed nip from the supply and along a path of travel;

a forming plow upstream of the pair of feed members and along the path of travel configured to fold the web longitudinally to juxtapose a top panel of the web over a bottom panel of the web;

at least one sensor adapted to detect location information for the sequential rows of inflated protrusions as the web travels along the path of travel;

a device moveable between (i) an engaged position to contact the web to perform one or more of separating the web transversely across the web or perforating the web transversely across the web and (ii) a disengaged position not engaging the web to separate or perforate the web; and a controller programmed (i) to receive the location information from the at least one sensor and (ii) to operatively control the device to move it to the engaged position when a selected row is in a determined position relative the device.

2. The machine of claim 1 further comprising a separator plate along the path of travel, downstream from the forming plow, and between the top and bottom panels of the web.

3. The machine of claim 2 wherein the separator plate is within the feed nip.

4. The machine of claim 1 wherein the at least one sensor comprises:

a top sensor for detecting location information for the sequential rows of inflated protrusions of the top panel of the web; and a bottom sensor for detecting location information for the sequential rows of inflated protrusions of the bottom panel of the web.

5. The machine of claim 4 wherein:

the pair of opposing counter-rotating feed members comprises a top rotating member and a bottom rotating member; and the controller is programed to receive the location information from the top and bottom sensors, to compare that location information, and to operatively control the relative speed of the top rotating member and the bottom rotating member to align the sequential rows of the top panel with the sequential rows of the bottom panel.

6. The machine of claim 1 further comprising a pair of opposing counter-rotating outfeed members forming an outfeed nip therebetween for receiving the web downstream from the device.

7. The machine of claim 1 further comprising a piercing element along the path of travel comprising a blade moveable between (i) an engaged position to pierce a transverse row of inflated protrusions of the web and (ii) a disengaged position not piercing the web.

8. The machine of claim 7 wherein the controller is programmed to operatively control the piercing element to move it to the engaged position when the selected row is in a determined position relative the piercing element.

9. The machine of claim 6 wherein the controller is programmed to operate the counter-rotating speed of the pair of outfeed members faster than the counter-rotating speed of the pair of feed members.

10. The machine of claim 6 wherein the controller is programmed to perform at least one of:

operating the counter-rotating speed of the pair of outfeed members faster than the counter-rotating speed of the pair of feed members at least (i) after the piercing element has pierced the selected row and (ii) before the selected row is in the determined position relative the device, whereby the machine is adapted to facilitate the flattening of the pierced selected row by the tension created in the web by the differing counter-rotating speeds of the feed and outfeed members;

operating the counter-rotating speed of the pair of feed members in a reversed direction relative the counter-rotating speed of the pair of outfeed members at least (i) after the piercing element has pierced the selected row and (ii) before the selected row is in the determined position relative the device, whereby the machine is adapted to facilitate the flattening of the pierced selected row by the tension created in the web by the differing counter-rotating speeds of the feed and outfeed members;

operating the counter-rotating speed of the pair of outfeed members while the counter-rotating feed members of the pair of feed members are stopped (i) while the selected row is in the determined position relative the device and (ii) after the severing blade having a serrated edge has pierced the selected row, whereby the machine is adapted to facilitate the flattening of the pierced selected row by the tension created in the web by the differing counter-rotating speeds of the feed and outfeed members;

operating the counter-rotating speed of the pair of outfeed members and the counter-rotating feed members of the pair of feed members in opposite directions (i) while the selected row is in the determined position relative the device and (ii) after a second piercing element adjacent the location of the device has pierced the selected row, whereby the machine is adapted to facilitate the flattening of the pierced selected row by the tension created in the web by the differing counter-rotating speeds of the feed and outfeed members; or stopping the counter-rotating speed of the pair of outfeed members and run the counter-rotating speed of the feed members of the pair of feed members in a reverse direction (i) while the selected row is in the determined position relative the device and (ii) after a second piercing element adjacent the location of the device has pierced the selected row, whereby the machine is adapted to facilitate the flattening of the pierced selected row by the tension created in the web by the differing counter-rotating speeds of the feed and outfeed members.

11. The machine of claim 1 wherein:

the distance between the pair of opposing counter-rotating feed members is adjustable to vary the feed nip distance, whereby the feed nip may accommodate webs having sequential transverse rows of varying inflated protrusion sizes.

12. The machine of claim 6 wherein the distance between the pair of opposing counter-rotating outfeed members is adjustable to vary the outfeed nip distance, whereby the outfeed nip may accommodate webs having sequential transverse rows of varying inflated protrusion sizes.

13. The machine of claim 1 wherein the device comprises a heating element adapted to separate the web transversely when the device is in the engaged position.

14. The machine of claim 1 wherein the controller is programmed to:

receive instructions from an operator interface device, the instructions including the length of the cushioning product; and operatively control the device between its engaged position and its disengaged position and the speed of pair of feed members in response to the instructions.

15. A method of making a cushioning product comprising:

providing the machine of claim 1;

providing a supply of a web material having sequential transverse rows of inflated protrusions; and operating the machine to manufacture the cushioning product from the web.

16. A machine for providing cushioning products of varying lengths from a supply of a web material having sequential transverse rows of inflated protrusions, the machine comprising:

a pair of opposing counter-rotating feed members forming a feed nip therebetween for moving the web through the feed nip from the supply and along a path of travel;

a forming plow upstream of the pair of feed members and along the path of travel configured to fold the web longitudinally to juxtapose a top panel of the web over a bottom panel of the web;

at least one sensor adapted to detect location information for the sequential rows of inflated protrusions as the web travels along the path of travel;

a device moveable between (i) an engaged position to engage the web to perform one or more of separating the web transversely across the web or perforating the web transversely across the web and (ii) a disengaged position not engaging the web to separate or perforate the web;

a sealing device along the path of travel of the web, the sealing device comprising:

at least one sealing element and at least one backing element opposing the at least one sealing element wherein:

the opposing sealing and backing elements are on opposing sides of the path of travel and are selectively moveable relative each other between (i) an engaged position of the sealing device, in which the sealing and backing elements compress the top and bottom panels of the web between the opposing sealing and backing elements to heat seal the panels together, and (ii) a disengaged position of the sealing device, in which the opposing sealing and backing elements are not in the engaged position; and a controller programmed (i) to receive the location information from the at least one sensor and (ii) to operatively control the severing and sealing devices so that at least one of the severing and sealing devices is in its engaged position when a selected row is in a determined position relative the respective severing and sealing devices.

17. The machine of claim 16 wherein the sealing device comprises:

an upstream sealing element and a downstream sealing element downstream from the upstream sealing element, each of the upstream and downstream sealing elements being independently selectively operable to a heated condition;

an upstream backing element opposing the upstream sealing element; and a downstream backing element opposing the downstream sealing element, wherein:

each of the opposing sealing and backing elements are on opposing sides of the path of travel and are selectively moveable relative each other between (i) an engaged position, in which the sealing and backing elements compress the web in the selected region between the opposing sealing and backing elements to heat seal the top and bottom panels together, and (ii) a disengaged position, in which the opposing sealing and backing elements are not in the engaged position; and the sealing device is selectively operable to:

an upstream seal mode in which the upstream sealing element and the upstream backing element are in the engaged position having the upstream sealing element in the heated condition to create a lead transverse heat seal across the folded web to join the top panel to the bottom panel; and a downstream seal mode in which the downstream sealing element and the downstream backing element are in the engaged position having the downstream sealing element in the heated condition to create a trailing transverse heat seal across the folded web to join the top panel to the bottom panel;

the controller is programmed to operatively control the sealing device to one, both, or neither of the upstream and downstream seal modes when the selected row is in a determined position relative the sealing device.

18. The machine of claim 17 wherein the device is downstream from the upstream sealing element and upstream from the downstream sealing element.

19. The machine of claim 17 wherein:

the selected row has a given width; and the distance between the upstream sealing element and the downstream sealing element is no greater than the given width of the selected row.

* * * * *